US007391314B2

(12) United States Patent
Lemmon

(10) Patent No.: US 7,391,314 B2
(45) Date of Patent: Jun. 24, 2008

(54) EVENT COMMUNICATION SYSTEM FOR PROVIDING USER ALERTS

(75) Inventor: Karla S. Lemmon, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 241 days.

(21) Appl. No.: 11/263,123

(22) Filed: Oct. 31, 2005

(65) Prior Publication Data

US 2007/0096894 A1 May 3, 2007

(51) Int. Cl.
*G08B 29/00* (2006.01)

(52) U.S. Cl. ..... 340/506; 340/3.1; 340/825.36; 340/825.49; 340/539.11

(58) Field of Classification Search ..... 340/506, 340/524, 525, 3.1, 825.36, 825.49
See application file for complete search history.

(56) References Cited

U.S. PATENT DOCUMENTS

| | | | | |
|---|---|---|---|---|
| 3,750,131 | A | 7/1973 | Fletcher et al. | |
| 5,132,521 | A | 7/1992 | Smith et al. | |
| 5,185,697 | A | 2/1993 | Jacobs et al. | |
| 5,195,126 | A | 3/1993 | Carrier et al. | |
| 5,260,986 | A | 11/1993 | Pershan | |
| 5,400,246 | A * | 3/1995 | Wilson et al. | 700/17 |
| 5,524,137 | A | 6/1996 | Rhee | |
| 5,568,556 | A | 10/1996 | Conley | |
| 5,793,870 | A | 8/1998 | Conley | |
| 5,797,630 | A | 8/1998 | Conley, Jr. | |
| 5,805,670 | A | 9/1998 | Pons et al. | |
| 5,872,926 | A | 2/1999 | Levac et al. | |
| 5,894,521 | A | 4/1999 | Conley | |
| 5,967,556 | A | 10/1999 | Conley, Jr. | |
| 5,987,100 | A | 11/1999 | Fortman et al. | |
| 5,999,193 | A | 12/1999 | Conley, Jr. | |
| 6,023,700 | A | 2/2000 | Owens et al. | |
| 6,112,074 | A | 8/2000 | Pinder | |
| 6,151,385 | A | 11/2000 | Reich et al. | |
| 6,217,074 | B1 | 4/2001 | Conley, Jr. | |
| 6,243,039 | B1 | 6/2001 | Elliot | |

(Continued)

FOREIGN PATENT DOCUMENTS

| | | |
|---|---|---|
| JP | 2002032881 | 1/2002 |

OTHER PUBLICATIONS http://www.tmcnet.com/, Products For Unfettered Communications, RME 5.0 From Banter, Targeted Communications From Egoware, pp. 1-3, printed from internet on Nov. 24, 2003.

(Continued)

*Primary Examiner*—Daryl C Pope

(57) ABSTRACT

An event communication system involves facilitating entry by a user of one or more device addresses via a network accessible user interface of the event communication system. The device addresses are associated with alerts provided by the event communication system. Test alert messages targeted for the device addresses are sent via the user interface. The system sends alerts user devices corresponding to the one or more tested device addresses in response to predetermined events. The system may provide user access to historical copies of data relating to the alerts. Registration on the system involves storing a personal identity data of a student on a database and comparing the personal identity data to registration data entered via the user interface. Authentication is automatically provided based on the comparison.

40 Claims, 21 Drawing Sheets

U.S. PATENT DOCUMENTS

| | | | |
|---|---|---|---|
| 6,295,346 | B1 | 9/2001 | Markowitz et al. |
| 6,404,880 | B1 | 6/2002 | Stevens |
| 6,434,745 | B1 | 8/2002 | Conley, Jr. et al. |
| 6,463,273 | B1 | 10/2002 | Day |
| 6,463,462 | B1 | 10/2002 | Smith et al. |
| 6,487,457 | B1 | 11/2002 | Hull et al. |
| 6,574,480 | B1 | 6/2003 | Foladare et al. |
| 6,617,964 | B1 | 9/2003 | Lamb |
| 6,842,772 | B1 | 1/2005 | Delaney et al. |
| 2002/0042846 | A1 | 4/2002 | Bottan et al. |
| 2002/0086659 | A1 | 7/2002 | Lauper |
| 2002/0120698 | A1 | 8/2002 | Tamargo |
| 2002/0184346 | A1 | 12/2002 | Mani |
| 2003/0006912 | A1 | 1/2003 | Brescia |
| 2003/0012344 | A1 | 1/2003 | Agarwal et al. |
| 2003/0048879 | A1 | 3/2003 | Wrona et al. |
| 2003/0069002 | A1 | 4/2003 | Hunter et al. |
| 2003/0078677 | A1 | 4/2003 | Hull et al. |
| 2003/0141971 | A1 | 7/2003 | Heiken, Jr. |
| 2003/0141990 | A1 | 7/2003 | Coon |
| 2003/0142797 | A1 | 7/2003 | Troy et al. |
| 2003/0163532 | A1 | 8/2003 | Kacalek et al. |

OTHER PUBLICATIONS http://www.e-gov.com/, Egoware's Private Internet Communication Channel™ Offers Companies Secure Alternative to Email & Direct Mail, pp. 1-2, printed from internet on Nov. 24, 2003.

http://www.bizjournals.com/dayton/stories/, Keeping it simple, Egoware expects to double its revenue this year by changing the way it labels products and appealing to new markets, pp. 1-5, printed from internet on Nov. 24, 2003.

http://www.egoware.com/, Egoware Client Case Study, Dayton Area Chamber of Commerce Strengthens Member Relationships with Egoware Software, pp. 1-2, 2001.

http://www.egoware.com/home/education.asp, Brand . . . Alert . . . Communicate, pp. 1-3, printed from internet on Nov. 24, 2003.

http://www.3nonline.com/, 3n: Automated Mass Notification System & Emergency Notification Services—National Notification Network, one call—reaches all, pp. 1-8, printed from internet on Mar. 16, 2005.

http:////www.eschoolnews.com, eSchool News Staff Reports, Jan. 1, 2005, School Safety & Security, How schools are using the latest technologies to keep their students safe, pp. 1-8, printed from internet on Mar. 16, 2005.

http://www.notification.com/, Notification Technologies, Inc., What is Connect-ED?, Your school needs a clear, consistent and reliable voice, pp. 1-2, printed from Internet on Mar. 16, 2005.

http://www.notification.com/, Notification Technologies, Inc., Get Connected with Connect-ED, pp. 1-3, printed from the Internet on Mar. 16, 2005.

http://www.saftnet.net/, Saf-T-Net Alertnow Rapid Notification, pp. 1-4, Printed from Internet on Mar. 16, 2005.

http://www.schoolmessenger.com/, School Messenger—Empowering educators with parent-notification solutions and services, pp. 1-6, Printed from Internet on Mar. 16, 2005.

http://www.schoolreach/com, SchoolReach One Call Calls Them All, pp. 1-2, Printed from Internet on Mar. 16, 2005.

http://www.synrevoice.com, School Connects, pp. 1-5, Printed from Internet on Mar. 16, 2005.

http://www.vericast.com, Vericast is a parent notification service providing better school communication, pp. 1-7, Printed from Internet on Mar. 16, 2005.

http://www.parlant.com, ParentLink "Gets parents involved", pp. 1-3, Printed from Internet on Mar. 16, 2005.

* cited by examiner

EVENT COMMUNICATION SYSTEM FOR PROVIDING USER ALERTS

FIELD OF THE INVENTION

The present invention relates to electronic communication systems, and more particularly to an electronic events notification system.

BACKGROUND OF THE INVENTION

In an emergency situation such as a fire, severe weather, a school shooting, or an act of terrorism, parents of children enrolled in a school affected by the emergency need to be notified of the situation and of what course of action to take. The most common emergency notification system for schools, however, is the phone tree. It can take hours to complete a phone tree, and the messages that find their way to parents are often inconsistent or incomplete. Furthermore, the situation may change before parents get the original message.

For non-emergency situations, such as school scheduled event or school sport scheduling changes, notifying parents of the changes in activities or scheduling is generally done through paper notices sent home with children. Parents may miss the paper notification for any number of reasons resulting in missed activities or the inconvenience of arriving for an activity that is scheduled for a later time.

Some electronic notification systems enable parents to become apprised of both emergency situations and school scheduling changes. However, the notification systems have drawbacks. For example, registration on an alert system may be time consuming and complicated if several registration steps and website visits are required to complete registration. Another problem may arise when electronic devices are used to notify parents. Device address entry processes may be problematic because a parent may not know if the contact device address is entered correctly or if the notification system is accurate until after an alert situation arises. This prevents a parent from responding to a situation in the same manner if the alert had been sent correctly. Even if the correct contact information is entered into a notification system, notification groups may be incomplete or inaccurate. Parents may not have a way to verify that they are members of desired notification groups and thus may not receive alerts from groups they thought they would. Another potential drawback to a notification system is that devices entered into a notification system may be unavailable to parents, and thus parents may be unable to check whether alerts have been sent.

Accordingly, there is a need for a method and apparatus that provides an improved notification system. The present invention fulfills these and other needs, and offers other advantages over the prior art.

SUMMARY OF THE INVENTION

To overcome limitations in the prior art described above, and to overcome other limitations that will become apparent upon reading and understanding the present specification, the present invention discloses a system, apparatus and method for providing alerts using an event communication system. In one embodiment, a method for testing an event communication system involves facilitating entry by a user of one or more device addresses via a network accessible user interface of the event communication system. The device addresses are associated with alerts provided by the event communication system. Test alert messages are sent via the user interface targeted for the device addresses. The test alert messages are confirmed to have been received at one or more devices corresponding to the device addresses, and thereafter alerts are sent to one or more user devices corresponding to the one or more tested device addresses in response to predetermined events occurring at a school.

In more particular embodiments, associating the one or more device addresses with alerts involves associating the one or more device addresses with a plurality of alert classifications. The alert classifications may include a plurality of alert levels and/or a plurality of subject matter classifications. Associating the one or more device addresses with the plurality of alert classifications may involve selecting spaces in a grid presented via the network accessible user interface. Each selection of a space in a grid creates an association between a selected alert classification of the plurality of classifications and a selected device address of the one or more device addresses. In other, more particular embodiments, the method further involves sending a confirmation message from the one or more user devices in response to receiving the test messages at the one or more user devices and/or indicating successful reception of the confirmation message via the user interface.

In another embodiment of the invention, a system includes one or more data communications networks. A user manager module is configured to, for each student at one or more schools, store a device address that can be used to access a communications device of a person responsible for each student via the data communications networks. An alerts module is capable of communicating with the user manager module and configured to receive an event notification via an authority associated with the one or more schools, and send an alert to selected device addresses in response to the event notification. A user interface module is capable of processing user inputs and outputs via one of the data communications networks. The user interface module is capable of communicating with the user manager module and alerts module. The user interface module is configured to, for a selected person responsible for at least one of the students, enable the sending of a test message by the selected responsible person via the alerts module to the device address that can be used to access the communication device of the selected responsible person.

In another embodiment of the invention, a method involves storing on a database personal identity information associated with a student at a school. Entry of registration information via a network user interface is facilitated for a person responsible for the student who has personal knowledge of the personal identity information. A specified portion of the personal identity information and the registration information is compared. The responsible person is registered with the system based on a successful comparison of the specified portion of the personal identity information and the registration information. Alerts are provided via a data communications network to one or more communications devices accessible by the responsible person based on the registration.

In more particular embodiments, the method involves facilitating entry of personal identity data associated with the responsible person secure via the network user interface in response to the registration for purposes of storing the personal identity data associated with the responsible person on the database. Storing on the database the personal identity information associated with the student at the school may include importing the personal identity information from a legacy data source and/or setting a default alert configuration used for providing alerts via the data communications network to the one or more communications devices accessible by the responsible person. The responsible person may be provided secure access to the database for purposes of modifying the default alert configuration.

In other, more particular embodiments, storing on the database the personal identity information associated with the student comprises storing a question and answer, wherein the person responsible for the student has personal knowledge of the answer. Storing on the database the personal identity information associated with the student may involve storing at least one of a school name, a state name, a home phone number, and a birth date of the student.

In another embodiment of the invention, a method involves providing a user interface of an event communication system that is accessible by an administrator of one or more schools. The definition of groups associated with the one or more schools is facilitated for the administrator via the user interface. The adding of members to the groups is facilitated for the administrator via the user interface. At least one of the groups is selected for reception of alerts via the user interface. Alerts are sent from the event communications systems to devices of the members of the at least one selected group.

In more particular embodiments, facilitating the definition of groups involves defining groups associated with school activities. Facilitating the adding of members to the groups may involve selecting a school from a list of the one or more schools. A list of members associated with the selected school may be selectable for addition to the group based on the selection of the selected school. In addition, a list of existing groups associated with the selected school may be selectable for addition to the group based on the selection of the selected school. In the latter case, adding members to the groups may involve selecting an existing group from the list of existing groups, wherein a list of members associated with the selected existing group are selectable for addition to the group based on the selection of the selected existing group.

In other, more particular embodiments, facilitating the definition of groups comprises forming an alert hierarchy having a plurality of groups within each of the one or more schools. Sending the alert may involve sending the alert to a selected school, so that the alert is sent to the plurality of groups within the selected school. Forming the alert hierarchy may further involve forming one or more districts, so that each of the one or more schools is within selected ones of the one or more districts. In this case, sending the alerts may involve sending the alert targeted for a selected district of the one or more districts, and then sending the alert to each group within each school within the selected district.

In another embodiment of the invention, a method involves facilitating network registration by a person having responsibility for a student to receive electronic alerts relating to the student. Alerts are electronically sent to a device of the responsible person via one or more data communications networks in response to an event affecting the student. Historical copies of data relating to the alerts are stored in a persistent storage. Access to the historical copies is provided to the responsible person via a network accessible user interface.

In more particular embodiments, providing access to the historical copy of the data involves providing the capability to search through the historical data via the network accessible user interface. The method may further involve detecting that the responsible person viewed the historical copies of the data relating to the alerts, and storing in the database records of whether the responsible person viewed the historical copies of the data relating to the alerts.

In other, more particular embodiments, storing the historical copies of data relating to the alerts in the persistent storage involves storing text messages contained in the alerts and/or storing at least one of dates, times, alert categories, and senders of the alerts. The method may also involve checking an age of the historical copies, and preventing automatic deletion of historical copies that satisfy a predetermined age.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of a system, apparatus, and method in accordance with the invention.

BRIEF DESCRIPTION OF THE DRAWINGS

The invention is described in connection with the embodiments illustrated in the following diagrams.

DETAILED DESCRIPTION

In the following description, reference is made to the accompanying drawings which form a part hereof, and in which is shown by way of illustration particular embodiments in which the invention may be practiced. It is to be understood that other embodiments may be utilized, as structural and operational changes may be made without departing from the scope of the present invention.

School alert systems (SASs) enable parents and guardians to be immediately notified of any situation and given appropriate action to take. In an emergency situation such as a fire, severe weather, a school shooting, an act of terrorism, or an accident, a SAS may alert parents via parental message centers that a situation has occurred and inform them as to what action needs to be taken. Parental message centers that receive SAS notifications may include email, PDAs, fax machines, phones, or cellular phones. Parents may be regularly updated by receiving subsequent alerts via the SAS which may indicate that an emergency situation has been resolved, for example.

Figure 1:
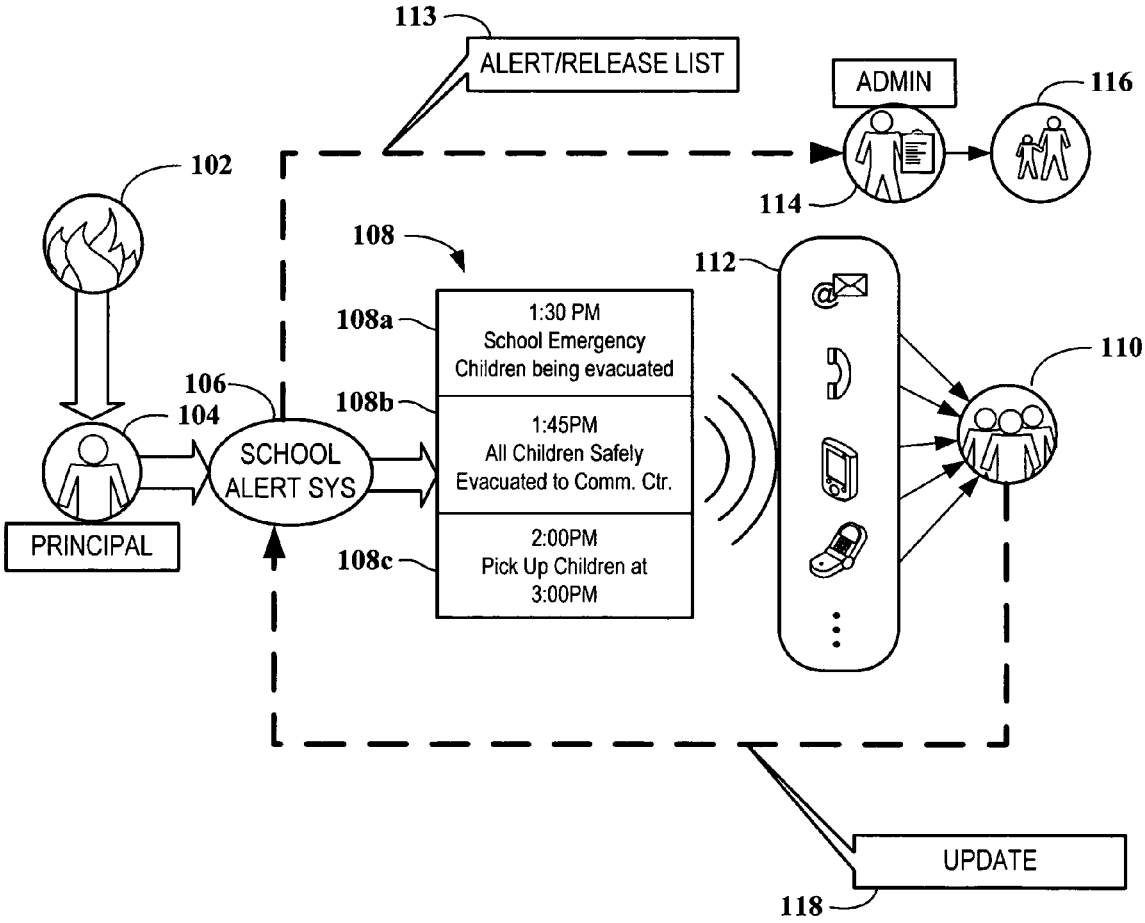
FIG. 1 is a block diagram illustrating a use case scenario according to an embodiment of the invention.

FIG. 1 illustrates the operation of a SAS in an emergency response example. In the case of a fire 102, the school principal 104 may send instant alerts 108 from the SAS 106 to parents 110 communicating how the emergency is being handled. These alerts 108 can be sent to any type of communication device, as represented by message centers 112. For example, one alert 108*a* sent to all parental recipients 110 at their designated message centers 112 may indicate that at 1:30 pm a school emergency occurred and that the children are being evacuated. A second alert 108*b* sent to all parental recipients 110 at 1:45 pm could indicate that all the students were safely evacuated to a community center. A third alert 108*c* sent to the parental recipients 110 at 2:00 pm may indicate that the children are to be picked up at 3:00 pm. The instant alert SAS may also trigger an alert 113 to be sent to a school administrator 114 containing information as to how to release the children from school and to which parents the children are to be released. This allows an orderly and safe release 116 of the children to the appropriate parents or guardians. In order to enable messages to be sent to desired message centers 112, parents 110 may update 118 their personal settings on the SAS in to receive messages at additional or different message centers 112.

School alert systems are useful for additional non-emergency situations such as changes in day-to day activities. For example, school sporting events may be cancelled or event locations may be changed. Other example uses for the SAS may include alerts for a bus breakdown or for an unplanned late school start or early dismissal. These situations may also be sent to parental message centers for quick notification and response. SAS can provide fast and effective communication to parents, allows rapid notification enabling fast response, and in emergency situations, enables compliance with U.S. DOE emergency response and crisis management guidelines.

School alert systems may be applicable for school districts having several schools or may be applicable for a single school. Accordingly, the alerts may be applicable district-wide, or may be applicable for a particular school, grade, class, activity, or any other subject matter classification.

SASs are flexible and applicable for a variety of recipients, e.g. from district-wide recipients to small group recipients, because alerts sent to parental message centers are easily customizable. Alerts may be configured by a system administrator for any given situation and may be stored in the system for use in the appropriate situation. Customized alerts may specify the information to be provided, which receivers or group of receivers are alerted, and for what reasons. This allows the alerts to be configured before an emergency situation arises. Alerts may also be created for daily communication purposes. Alternatively, alerts may be pre-configured. Alerts may remain in the system until deletion. Furthermore, alerts may be created, edited, and deleted at any time. Search capabilities may also be used by an administrator on the alerts page to find details of a specific alert, for example.

Customizable alerts in the SAS may be created with alert levels. For example, the following five alert levels may be available: school closing (red), high importance (orange), transportation (yellow), activities (blue) and general (green). The schools define for themselves what each of the alert levels means for their respective school, and they may re-name the alert level name descriptions and actions associated with each alert level. For example, the SAS system may be configured so that the school closing (red) alert is the only alert level sent to telephones, while all other alert levels are sent via text only.

In addition, the customizable alerts may include text fields. For example, an alert description field similar to a subject line for e-mail or a SMS field for text messaging devices may be included. The subject line normally contains up to 100 characters, and the SMS field normally contains up to 140 characters. A complete message field allows for a longer message in an e-mail, for example, and may also be included in an alert. In the case of a school closing (red) alert, this longer message may be converted to an electronic voice and sent to telephones. The complete message may contain up to 2,500 characters, for example. Alerts may also be created in a variety of languages such as English, French, and Spanish.

Another reason SASs are flexible is because parents and other alert recipients can easily configure their personal profile in order to receive SAS alerts at preferred message centers. A variety of choices and combinations for alert delivery are available to alert recipients. For example, phones, cell phones, e-mail, PDAs, and pagers are all considered message centers and may all receive the SAS alerts. Contact information for each message center is entered into the profile of the parent, stored, and used by the SAS to send alerts.

Alerts of a certain level may be delivered to all message centers on the parent's personal profile, while alerts of another level may be delivered to one selected message center on the personal profile. For example, in an emergency (red level), a message will be sent to every channel on a parent's contact list, but for a transportation problem (yellow level) a message will only be sent to the home phone on a parent's contact list. Contact preferences and important contact information may be updated on a parent's personal profile at any time. This gives families personal control over critical communications.

Personal profiles may also contain temporary information for time periods when parents are unavailable. For example, when grandparents or other guardians are watching the children, such as when parents are traveling, the family can instantly change the primary emergency contact information online. Information may also be entered indicating which adults on the contact list have pick-up rights. Allowing parental control over the parent's personal profile improves system accuracy because the parent-updatable SAS alert system offers greater assurance that a message will get through in a timely manner. In addition, the administrative burden of updating contact lists is removed.

SASs are also flexible because of such system's network-based nature. For the purposes of this disclosure, the network-based system will be referred to as a web-based system. The web-based SAS has two main interfaces. One main interface is for school administrators who send messages, and the second main interface is for parents and staff to set personal profiles. Both main interfaces are web-based and communicate with the SAS using a web connection. However, although the SAS is web-based, an alert may be sent using both a web-based interface and a toll-free technical support line, for example.

The administration interface includes a variety of administrative levels, and requires only basic computer proficiency so that any designee can perform administrative functions. Generally, each school has one primary system administrator who can assign system designees.

Figure 2:
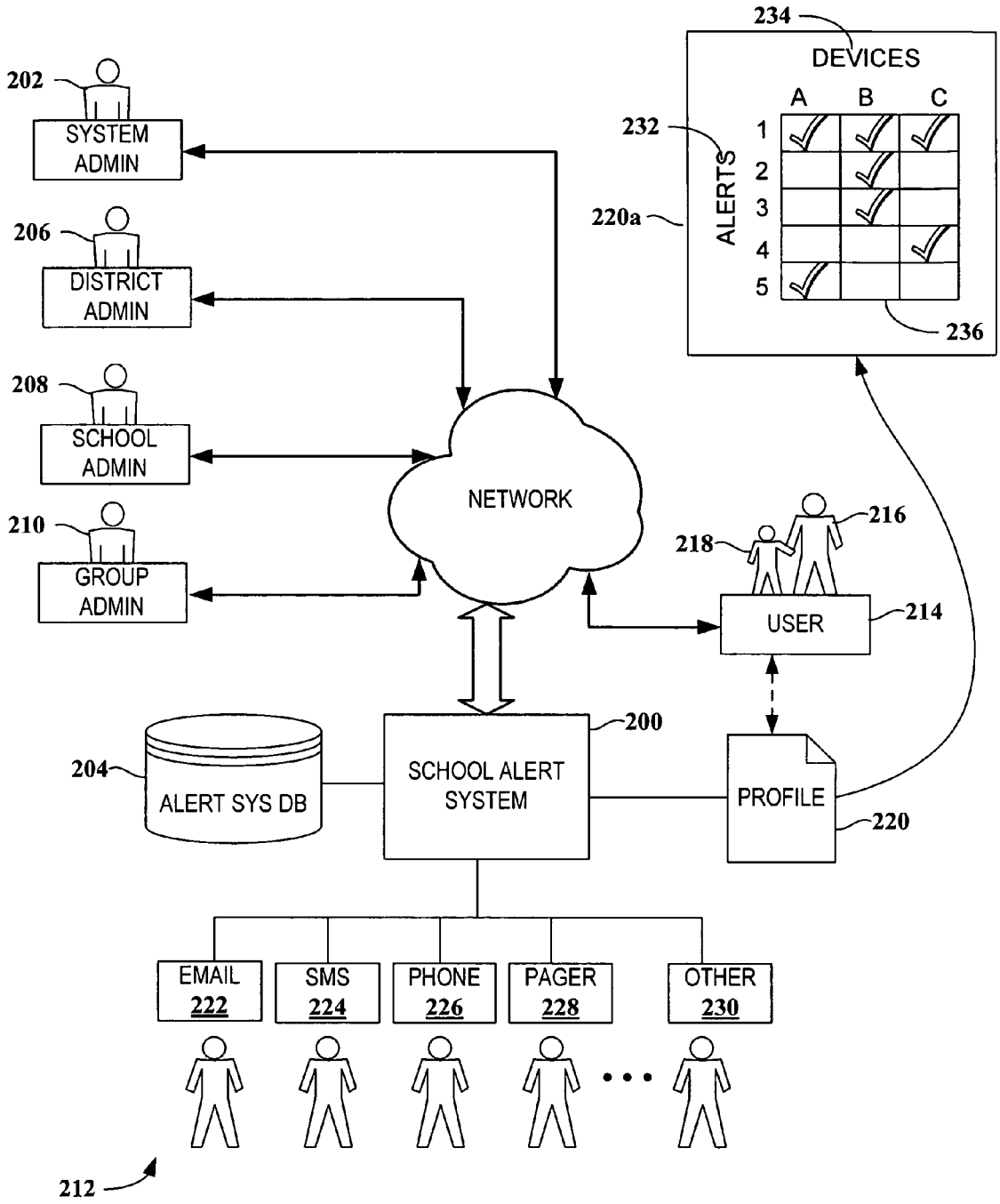
FIG. 2 is a block diagram illustrating a system level arrangement according to an embodiment of the invention.

FIG. 2 illustrates a system level block diagram according to an embodiment of the invention. FIG. 2 depicts the administrative and user levels that communicate over a web-based connection with the school alert system 200. In the illustrated arrangement, the system administrator 202, considered the top-level administrator, controls an administrator interface profiles section of the SAS that contains records of those people who are involved with the school such as students, parents, and staff. Initially, a school alert system database 204 is pre-loaded at the system administrator level 202 with the schools' existing databases. In addition, the system administrator 202 has the ability to add, edit and delete schools, staff, parents and students from the SAS 200 as necessary. Other functions of the system administrator 202 include creating accounts for district, school, and group administrators 206, 208, 210, setting clearance levels for the administrators 206, 208, 210, and performing management tasks. The system administrator 202 may also control a billing interface for each school district or private school implementing the SAS.

The SAS 200 includes interfaces configured by the system administrator 202 that are accessible by next-level district, school, and group administrators 206, 208, 210. If the SAS instant alert is implemented at an entire school district, the application 200 has an interface for the district administrator 206. As with an individual school, an all staff, all parents and all students group are pre-created for the district. The district administrator 206 has a clearance level to send district-wide alerts to all of the district's parents and/or staff members. When the district administrator 206 sends a message to one of these groups, the system automatically sends the message to these groups at each of the schools. The district administrator 206 may also view a district-wide alert history.

The school administrator 208 is given broad authority over the configuration of the SAS 200. The school administrator 208 configures and sends alerts of any alert level to any group. The school administrator 208 configures profiles of students, parents, and staff members. In addition, the school administrator 208 can create groups and associate group administrators 210 having assigned alert authority, and may add members to the group. The school administrator 208 may also view reports regarding alerts sent such as child pickup reports, emergency contact reports, and registration reports.

Groups are placed under the direction of a group administrator 210 and are also assigned an alert authority. The group administrator 210 can send alerts to groups for the group they are the administrating, but may only be allowed to send alerts of a priority up to and including the alert authority to which the group was assigned. Although the group administrator 210 may primarily originate group alerts, it will be appreciated that alerts targeted for particular groups may originate at the district administrator 206 and school administrator 208 levels. For example, if a district-wide storm warning is received by the district administrator 206, the district administrator 206 may send a district-wide alert to all groups related to outdoor sports in order to cancel outdoor activities.

School administrators 208 can edit the group administrators and their group's alert authority. The groups section of the SAS 200 allows the school administrator to place students, parents and staff into an unlimited number of communication groups. A group may contain any amount of message recipients 212. Once a group is created, people can be added and deleted as necessary. Groups may be built by such classifications as grade level, classroom, sport team, bus route, extracurricular group, and teacher or parent organization, and may be built using a variety of methods. In a first method, the group is populated with students. When an alert is sent to a student group, parents and the parents' top four designated contacts will receive the alert. Using a second method, the school administrator populates the group with adults—either parents or staff. Only the parents or staff will receive alerts sent to this type of group. When a new profile is created, that person is automatically inserted into the applicable group(s). This allows alerts to be sent to only those people who are affected by the information. In addition, search capability may be used on the group's page to find details of a specific group.

The second main interface of the SAS is provided for the benefit of users 214. Generally, the user interface is used by parents 216 to register on the SAS. Other types of users 214 besides parents may also utilize a user interface, such as staff members, bus companies, school security, fire and police departments, etc. For security purposes, web-based SAS registration may require authentication procedures involving several visits to a registration site. For example a user 214 may authenticate their own identity, and the SAS 200 validates and sends a confirmation email that includes a link enabling completion of registration. Some systems may require a user 214 to complete registration within a certain time period or the authentication process may need to be repeated.

The SAS user interface allows users 214 to access and maintain a user profile 220. The user 214 may add, modify, and delete contacts, prioritize alert contacts, and configure which contact receives alerts on what type of device. The user profile 220 may contain contact information about parents 214 and children 218 and allow the interface and alerts to be written/spoken in a particular language (e.g., English, Spanish). In addition, the parents 216 may be able to set an "out-of-town" feature. The out-of-town feature allows parents 216 to select someone else as the main contact for their children 218 in case they are out of town and have left their children 218 in the care of another person.

An "other contacts" area of the user profile 220 allows a parent 216 to add other people who may be responsible for the student at a given time, such as a nanny, neighbor, grandparent, or friend. These contacts may be assigned by child 218 and also be designated with child pick up rights. Those designated with pick up rights will appear on the school's child pick up report. Parents 216 are also able to allow a number of people to additionally receive alerts from the school. The additional contacts associated with each student 218 will also appear on the school's emergency contact report. Each contact can be designated with a preferred alert language.

As illustrated, alerts may be sent to message recipients 212 using many forms of communication, including email 222, Short Message Service (SMS) 224, phone 226, pager 228, and any other communications means known in the art, as represented by other device 230. The users 214 and other message recipients 212 may wish to specify certain alerts for certain devices. An "alerts section" **220*a* of a user profile allows the users 214 to select which alerts 232 they would like to receive on which contact device 234. Users 214 are able to check spaces on a grid 236 that indicate on which device 234 they would like to receive which alert type 232. They are also able to add additional contact devices 234. In some implementations, devices 234 such as phones may only receive school closing alerts, while e-mails and text messaging devices may receive all alert types. In some implementations, all users 214 in the system whose home phone numbers are pre-loaded in the system will receive school closing alerts regardless of registration status. Once users 214 are registered, they will be able to add other contact devices 234 as well as modify other aspects of their user profile 220**.

It should be noted that a personal profile 220 is not limited to the sections described above, and is not limited to parents 216. For example, The SAS user interface may also be utilized by a school staff member or other responsible person in order to receive pertinent alerts.

Figure 3:
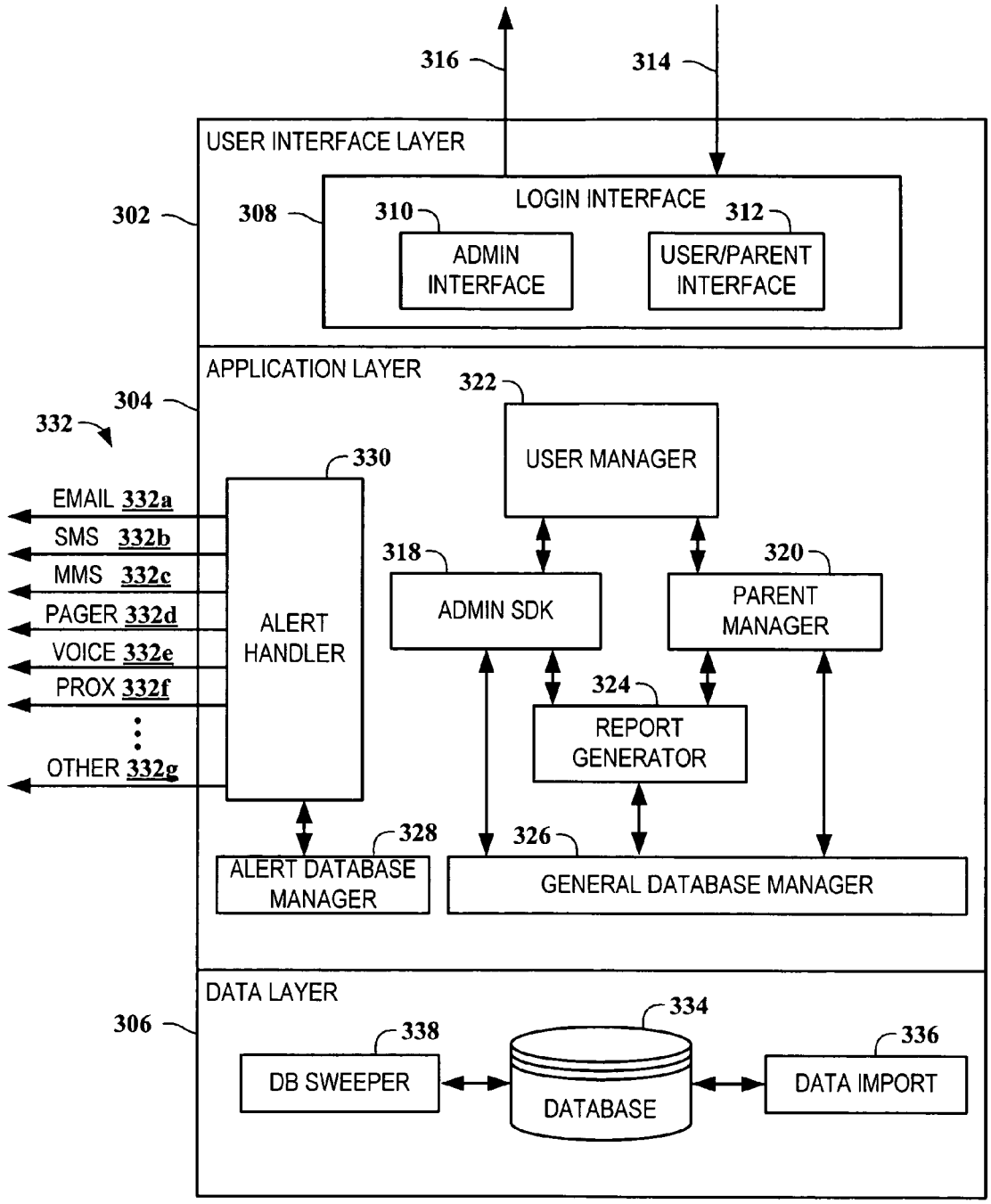
FIG. 3 is a block diagram illustrating a software architecture according to an embodiment of the invention.

An SAS software architecture diagram according to an embodiment of the invention is shown in FIG. 3. The subsystem generally includes three functional layers, a user interface layer 302, an application layer 304, and a data layer 306. The user interface layer 308 contains a login interface 308 that provides user access via a network. Here the term "user" is applied generically to all people that might need to access the system, including administrators and end users.

A login interface 308 provides initial access to the users for performing SAS operations. Because only authenticated and authorized users can perform certain operations, the login interface 308 must determine the identity of each user using authentication methods known in the art. Based on the authorization/authentication (e.g., admin or user), the login interface 308 can invoke the appropriate user interface for performing operations. The login interface 308 can invoke at least two different interfaces, an administration interface 310 and a user/parent interface 312. Generally the administration interface 310 is accessible by those people who can affect system-wide changes, generate alerts, and perform other command and control tasks needed for system operation. The user/parent interface 312 is used to view and modify user-level settings, as well as view alerts and other forms of communications.

The user interface layer 302 may be implemented using any local or distributed text or graphical user interface technologies. For example, the interface layer 302 may be made accessible via networks such as the Internet through use of a Web server. Web server interfaces are commonly implemented using documents (e.g., HTML, XML) provided by applications such as Apache™ Web Server and Microsoft™ Internet Information Services (IIS). The user interface layer 302 is typically limited to handling the receipt of user inputs 314 and processing of output data 316 to the user. The underlying business logic is primarily handled by the application layer 304.

The application layer 304 may contain an administrator module 318 and user/parent module 320 for managing tasks associated with respective interfaces 310, 312. The administrator module 318 is responsible for activities covered by administrators such as system administrators 202, district administrators 206, school administrators 208, and group administrators 210 as described in relation to FIG. 2. The user/parent module 320 handles activities associated with user 214 and parent 216 roles as described in relation to FIG. 2.

A user manager 322 may control common tasks associated with user access, such as authentication, session management, logging, etc. The user manager 322 may initially authenticate the user name and password, and identify a role and set of associated privileges for the user who logged in. Depending upon privileges, appropriate permissions will be displayed dynamically to the user. It will be appreciated that additional roles besides administrator and parent/user may be similarly implemented by providing an interface module via the login interface 308 for access and an associated manager module via the user manager 322 for the underlying logic.

A report generator 324 may interface with the user modules 318 to gather, format, and publish reports related to alerts statistics, usage, performance, debugging, etc. These reports may be saved to permanent storage via a general database manager 326. The report generator 324 may be configured to display the report using standard document formats such as XML and XSLT, and may also provide printing capability.

The general database manager 326 provides a common interface for managing persistent storage via the data layer 306. This data can be saved/read via the user and admin modules 318, 320 as well as any other non-alert related component. The general database manager 326 provides functions for executing queries, stored procedures to retrieve data from the database. The manager may also provide functions for addition/modification/deletion of data and audit fields into the database. Data storage and retrieval is critical to overall functioning of the system, therefore the general database manager 326 is implemented with both performance and reliability in mind.

Generally, the alert data may be maintained by a specialized alert database manager 328. Generally, alerts need to be sent as quickly as possible, therefore the separate alerts database manager 328 can be implemented with performance as the major criteria. The alert database manager 328 provides functions for executing queries, stored procedures to retrieve data from the database. The alert database manager 328 provides data to an alert handler 330 that deals with near-real time generation and disbursement of alerts and other important message traffic.

The alert handler 330 deals with the real-time or near-real-time dispatching of alerts to message recipients. The alert handler 330 generally classifies alerts according to such factors as subject, priority, destination devices, etc. The alert handler 330 is configured to send alerts to message recipients via any number of communication channels 332, including the respective output devices such as email 332*a*, SMS 332*b*, MMS 332*c*, pager 332*d*, voice 332*e*, proximity communications 332*f* (e.g., Bluetooth or infrared), or any other communications medium and protocol 332*g*. The alert handler 330 may be multithreaded to more efficiently dispatch alerts in parallel. For example, a thread could be associated with each communication channel, and/or threads could be associated with different alert priority levels.

The data layer 306 provides efficient persistent data storage and fast lookup for the application layer logic 304. The central repository takes the form of one or more databases 334. Generally, the database 334 is a specialized data storage and retrieval element optimized for efficient storage and lookups, reliable transaction processing, and ensuring data integrity. Examples of databases include relational databases such as Microsoft™ SQL Server, Oracle™, Sybase™, MySQL™, etc. A data import module 336 allows easy import of data into the database from other (e.g., legacy) data sources, including text documents, spreadsheets, other databases, XML documents, etc. A database sweeper module 338 polls the database 334 for maintenance purposes such as deletion of alert history that is beyond a predetermined age.

Figure 4A:
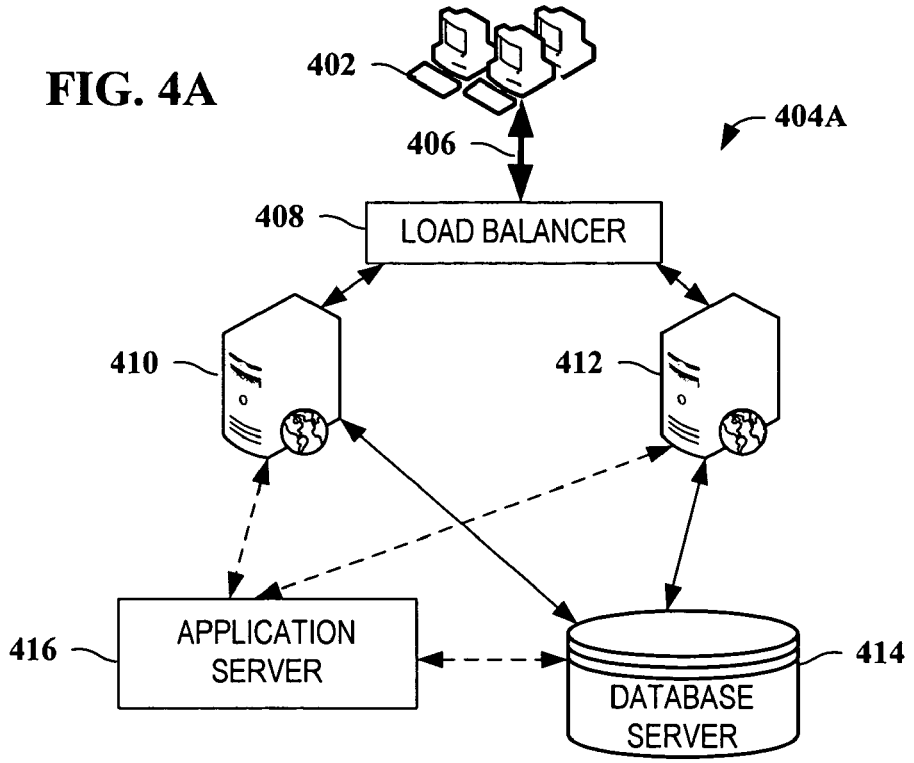
FIGS. 4A and 4B are block diagrams illustrating network configurations according to embodiments of the invention.
Figure 4B:
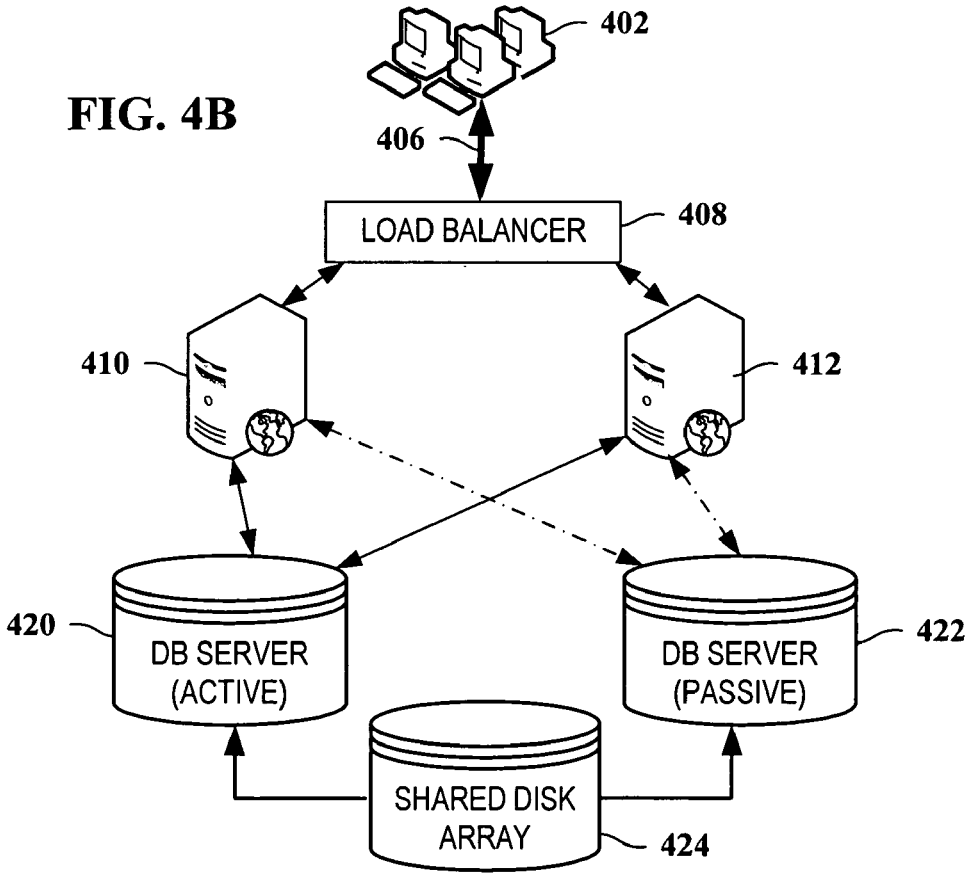

The various layers 302, 304, 306 may be implemented using any manner of data processing hardware known in the art. More particular architectures for implementing the logical layers are shown in FIGS. 4A and 4B. In FIG. 4A, a plurality of Web clients 402 are configured to access the SAS system 404A via network connections 406. The network connections 406 may be instantiated over any combination of public and private networks, and may use secure protocols such as HTTPS or SSH. A load balancer 408 allow two Web servers 410, 412 to equally share the load of incoming data traffic. Normally, both the Web servers 410, 412 may share the load via the load balancer 408. However, if one of the Web servers 410, 412 goes down, the other Web server 412, 410 will handle the complete load.

The Web servers 410, 412 may provide user interface elements to the clients 402 via Web documents, and may also handle various aspects of the business layer, which may include the administrator SDK 318, report generator 324 and alert handler 330 as shown in FIG. 3. In an alternate arrangement, an application server 416 may handle the business layer logic, so that the Web servers 410, 412 only handle pure user interface functions such as the presentation of Web pages and/or other graphical/textual elements.

In the architecture of FIG. 4A, a single database server 414 is utilized. The database server 414 may host the database jobs (e.g., the database sweeper 338 in FIG. 3) as well as other data related applications (e.g., data import 336 in FIG. 3). An alternate arrangement is shown in FIG. 4B, where a two database servers 420, 422 are used to provide fault tolerance. The databases 420, 422 utilize fail-over clustering, where the first database server 420 is active and the other database server 422 is passive. The active database server 420 would serve the clients at any point of time. If the active database server 420 fails, then the passive database server 422 would become active thereafter to serve the clients. The two database servers 420, 422 can communicate via a shared disk array 424. As in FIG. 4A, the database servers 420, 422 can host the database jobs as well as other data related applications. The architecture shown in FIG. 4B may also utilize an application server (not shown) similar to application server 416 in FIG. 4A in order to offload business functionality from the Web servers 410, 412.

The SAS provides both administrative and parental benefits. Even so, it will be appreciated that parental authentication and registration may be time consuming and complicated when several registration steps and website visits are required to complete registration. Another problematic aspect is determining whether the electronic devices set to receive alerts are configured correctly. If the electronic device is defective, or a setting on the SAS system is inaccurate, a parent may not be sure that alerts will be received until after an alert situation arises. If the alert is sent incorrectly and not received, a parent may not be able to respond in the same way they could have if the alert had been sent correctly. Even if a parent enters the correct contact information, the groups they are members of may not be accurate. Parents may not have a way to verify that they are members of all desired groups and thus may not receive alerts from groups they thought they would. Another potential drawback to an SAS system is that the devices entered into a parent's personal account may not be available, and thus parents may be unable to check whether alerts have been sent. In order to effectively deal with these situations, various registration improvements are describe hereinbelow.

Registration

Figure 5:
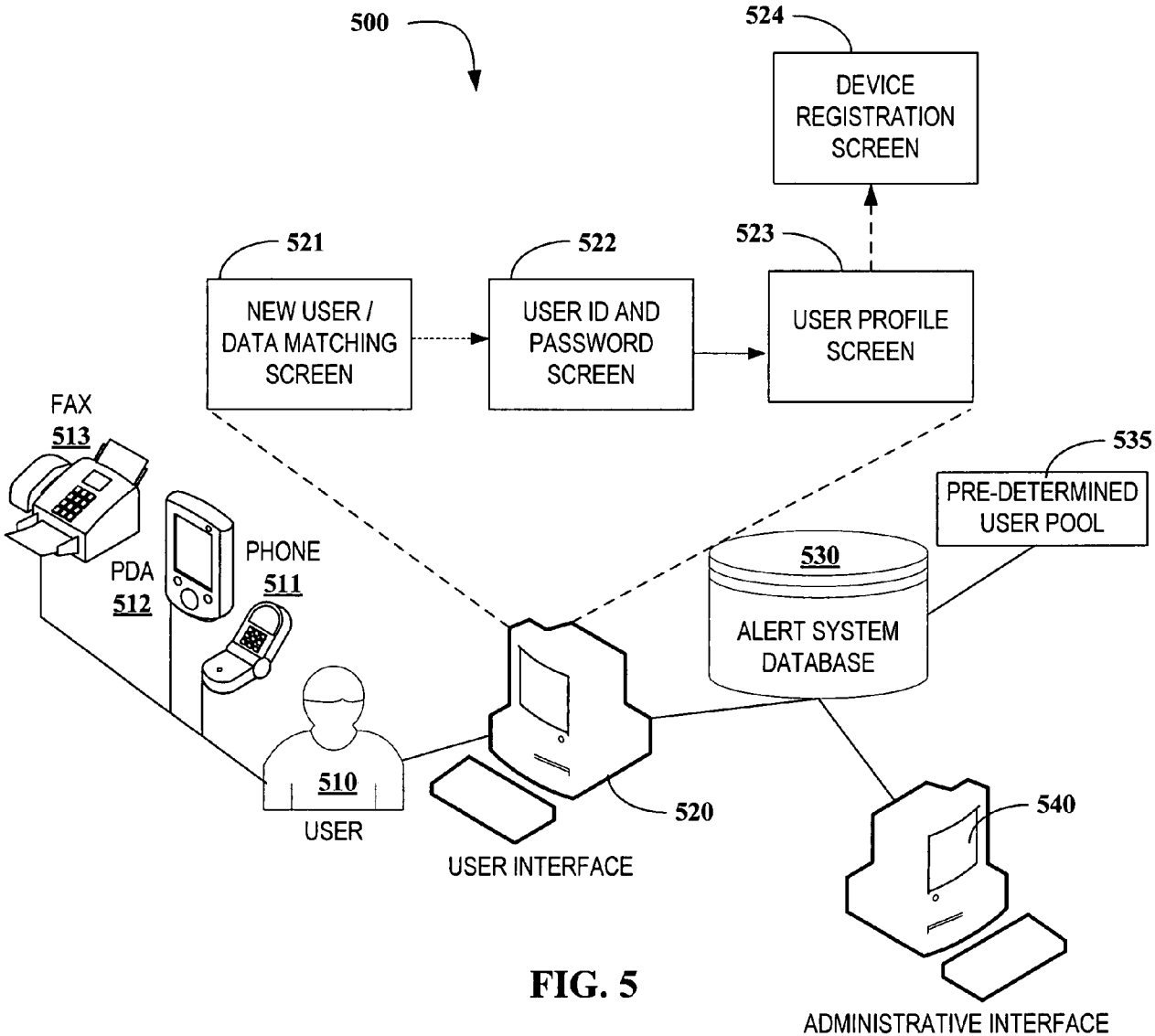
FIG. 5 is a block diagram illustrating a registration process according to an embodiment of the invention.

A streamlined registration process may allow a more user-friendly SAS registration procedure. FIG. 5 illustrates a block diagram of a school alert system 500 allowing for streamlined user registration according to an embodiment of the invention. Alert system 500 includes alert system database 530 communicatively coupled to user interface 520 and administrative interface 540. Pre-determined user pool data 535 is loaded into alert system database 530. The user pool data 535 may be received directly from the administrative interface 540, or may be entered through other data entry paths. For example, the user pool data 535 may be imported or otherwise accessed from a legacy database.

User 510 registers with the school alert system by entering personal information on user interface 520 at new user/data matching screen 521. At least a portion of the information entered is preferably information that is user-specific and personal to the user. User-entered data is compared at alert system database with pre-determined user pool data. If the information entered by the user matches the pre-loaded user pool data, the user 510 is automatically registered and is sent to a screen 522 that allows the user to enter a user ID and password. Submitting the user ID and password completes the user registration process and user 510 may access a secure portion of the alert systems database.

For example, user 510 may submit their unique user ID and password to school alert system and then proceed to a user profile screen 523 which is in a secure area of the alert system database 530. The user profile screen 523 facilitates user entry of personal information and may include device registration fields, or may be linked to a device registration screen 524. Device registration screen 524 is where user 510 may enter contact information for devices such as a user's phone 511, PDA 512, or fax 513. While streamlining the school alert system registration process allows easy registration for users, requiring user 510 to register in order access to their user profile and device registration screens allows the school alert system and the user profile information to be secure.

Figure 6:
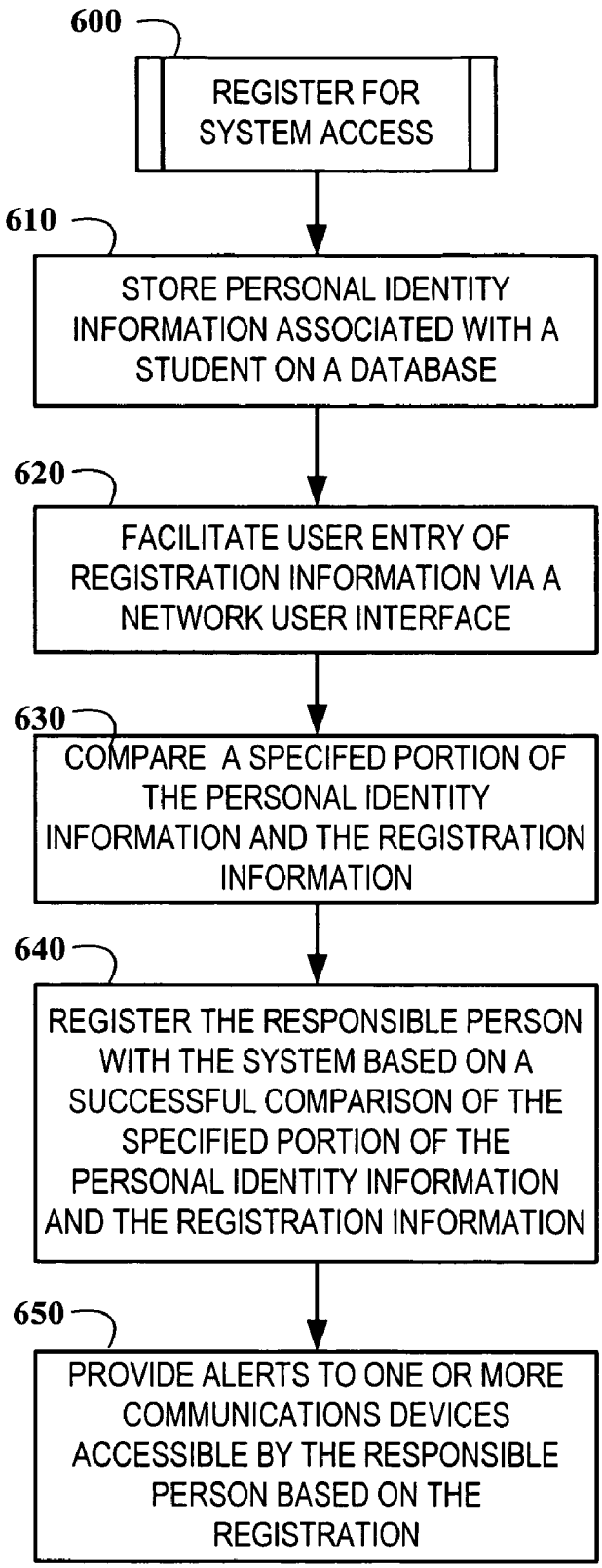
FIGS. 6 is a flowchart illustrating registration procedures according to embodiments of the invention.

FIG. 6 illustrates a method 600 for registering for access to a system according to an embodiment of the invention. Method 600 involves storing 602 on a database personal identity information associated with a student at a school. Entry of registration information is facilitated 620 via a network user interface by a person responsible for the student who has personal knowledge of the personal identity information. A specified portion of the personal identity information and the registration information is compared 630. The responsible person is then registered 640 with the system based on a successful comparison of the specified portion of the personal identity information and the registration information. Thereafter, alerts are provided 650 via a data communications network to one or more communications devices accessible by the responsible person based on the registration.

FIGS. 7A-7D illustrate screens 700, 701, 702, and 703, respectively, depicting steps for registering on a school alert system. Screen 700 in FIG. 7A includes a new user link 705, a login user ID field 720, and a password field 725. When a registered user visits the alert system site, the user enters a user ID and password in the appropriate fields. If a new user visits the site, the new user link 705 is selected which enables the user to enter personal information at screen 701 at FIG. 7B.

Figure 7A:
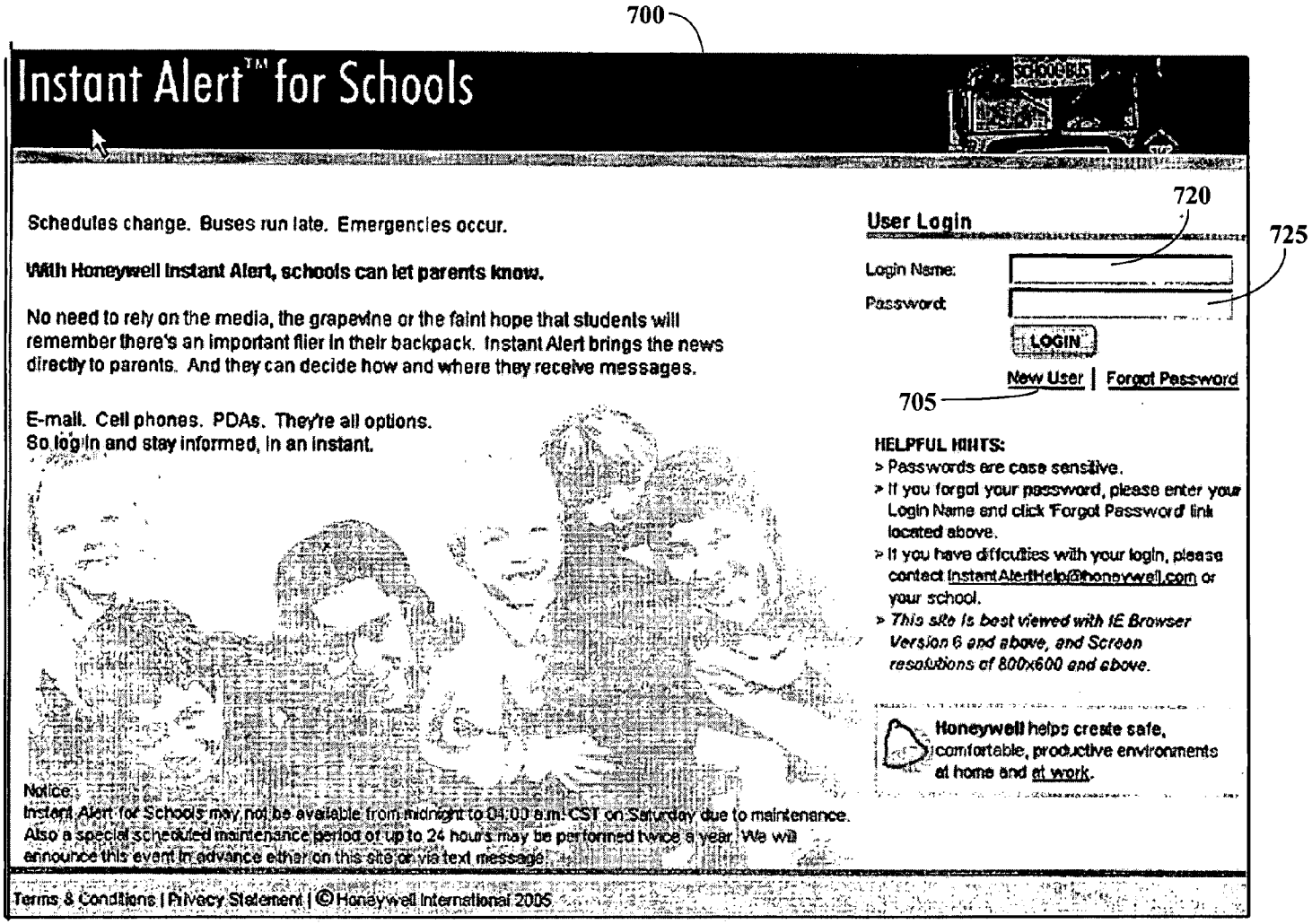
FIGS. 7A, 7B, 7C, and 7D are user interface diagrams illustrating registration interfaces according to embodiments of the invention.
Figure 7B:
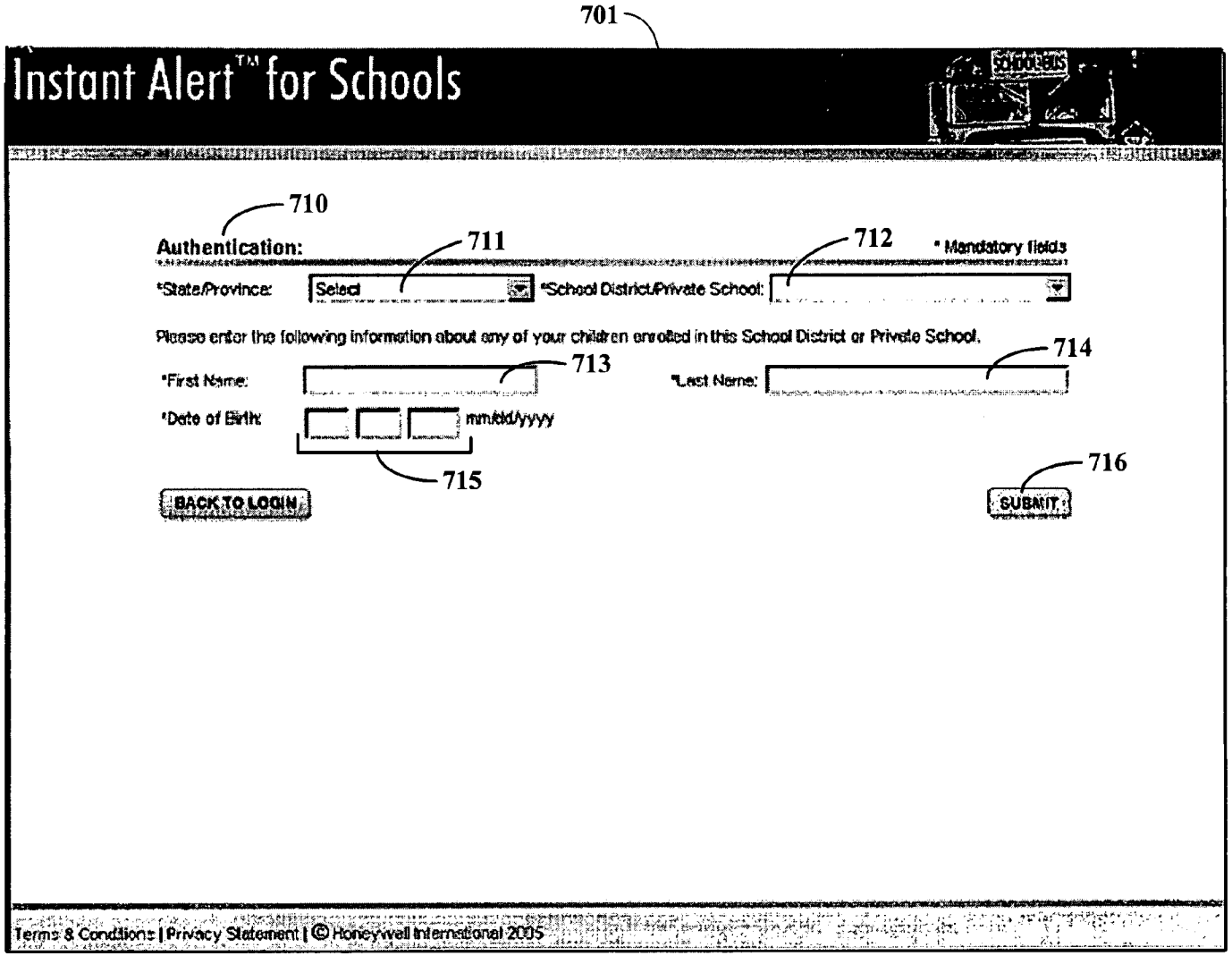

In FIG. 7B, a parent (or any other person responsible for a child) attempting to register with the school alert system is prompted to enter a child's personal information in the authentication section 710 of screen 701. Fields related to a child's personal information may include a state field 711 indicating the state the child's school is in, a school name field 712 indicating the school the child is enrolled in, name fields 713 and 714, and a date of birth field 715. Child information entered at the above-described fields are sent to an alert system database once the submit button 716 is selected. If information stored at the alert system database and the user-entered information match, screen 702 found at FIG. 7C may appear at a user interface for allowing completion of parent registration on the school alert system.

Figure 7C:
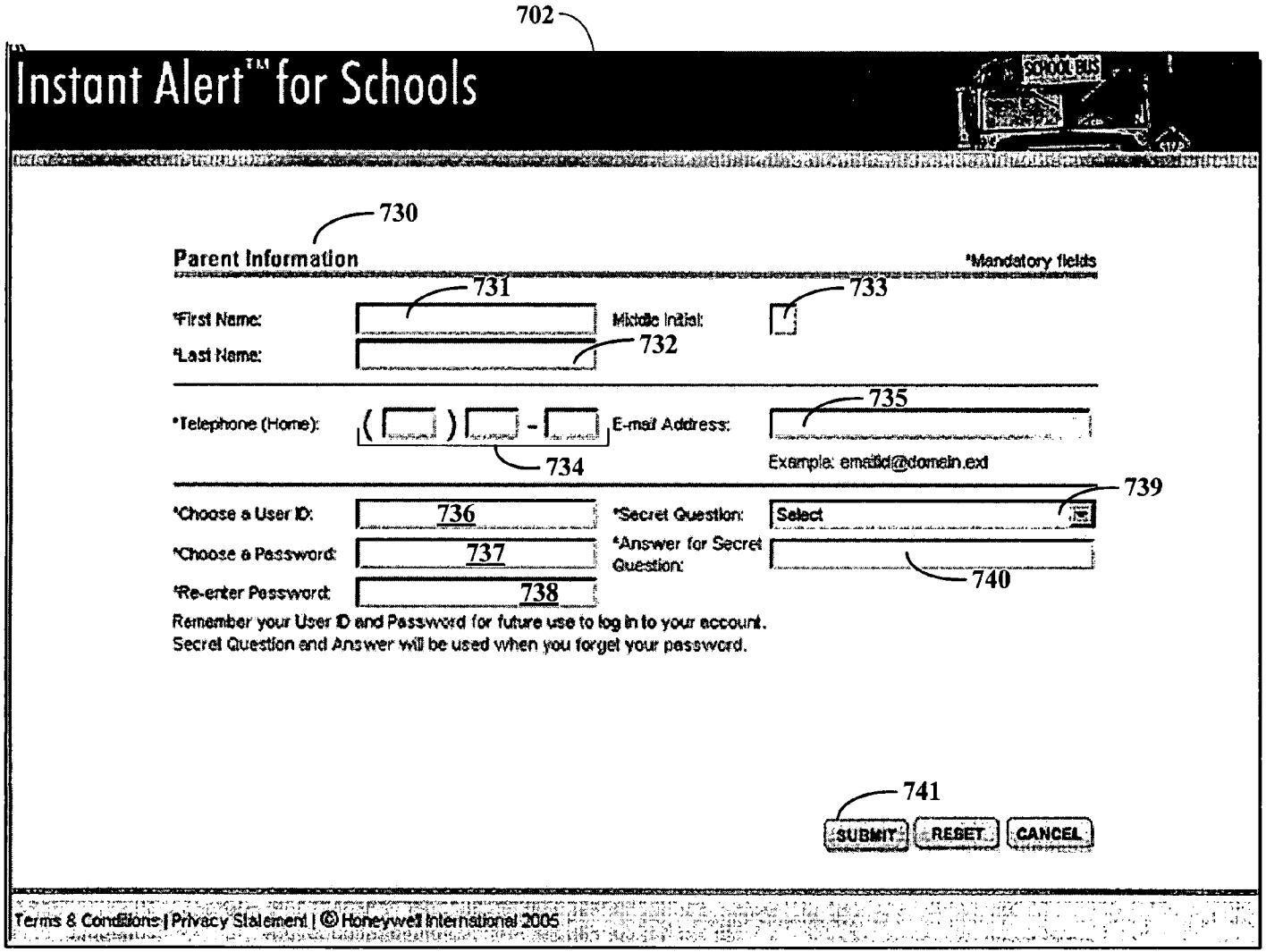

FIG. 7C illustrates screen 702 having parent information section 730 that may include fields for parent identification including name fields, 731, 732, and 733, a home phone field 734, and an email address field 735. Some parent personal identification information may be optionally entered, such as a parent's email address. This enables a parent without email access to register on the alert system. The parent information section 730 further includes user ID and password fields 736, 737, 738, and a secret question 739 and answer field 740. Once a user has entered the parent information and unique user ID and password information required at screen 702, the information may be entered by selecting the submit button 741. By selecting the submit button 741 the user completes a one-time registration process and is given confirmation of user registration at screen 703, FIG. 7D.

Figure 7D:
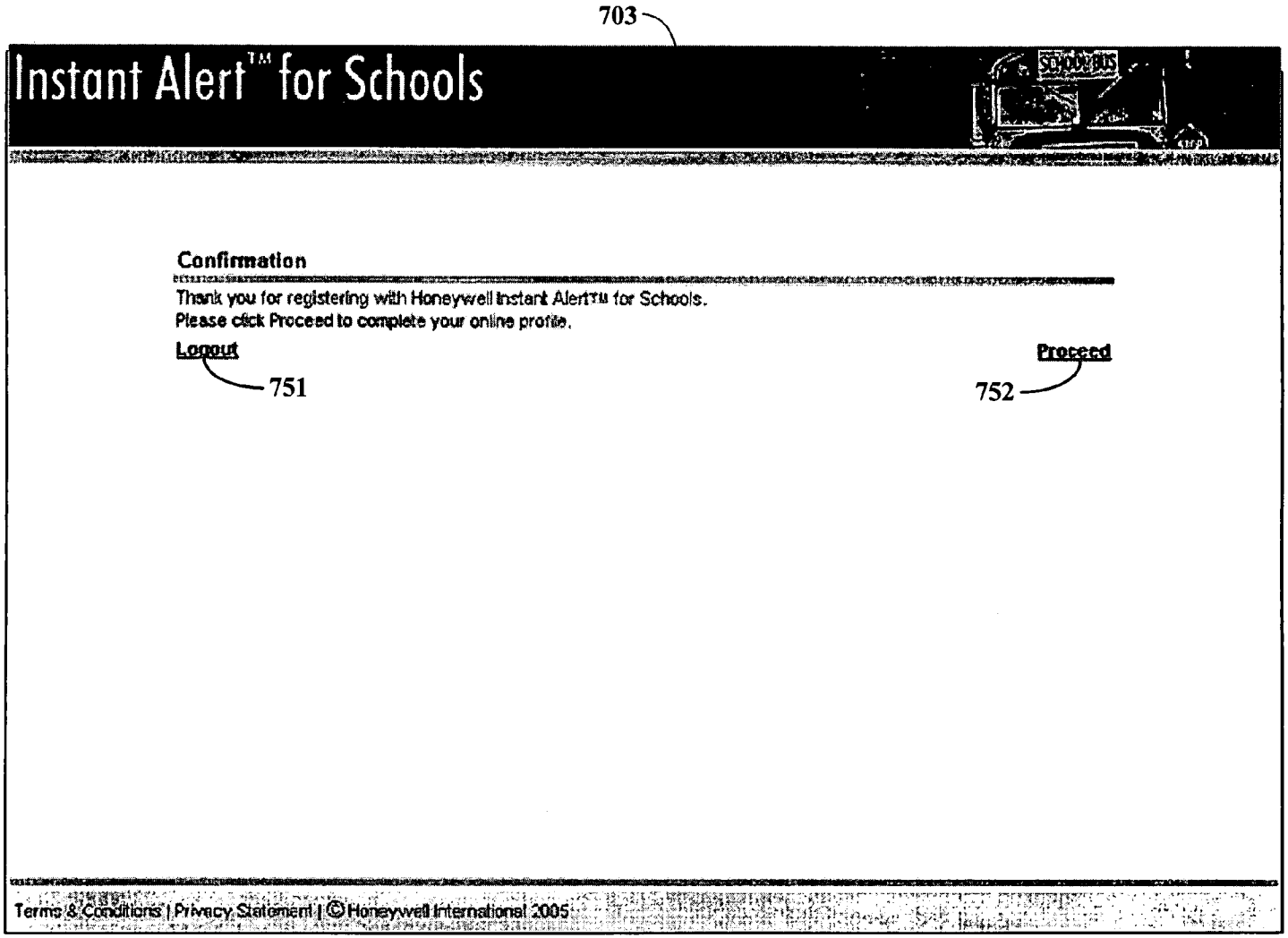

In FIG. 7D, confirmation screen 703 further includes links for logging out 751, or for proceeding to a user's personal profile 752 for personalization and updates. Once a user has logged out of the alert system, the user may gain access to the system by entering user ID and password information as screen 700 in FIG. 7A.

When parents or users are logged on to the alerts database website, parents are able to change their own passwords. If a password is forgotten, a parent is prompted with their secret question and answer in order to have a new password assigned. For alert system users that forget their username, the user may have to contact the alert system manager or help desk in order to have a new user ID and password assigned. In the case of a two-parent household, both parents may share one joint profile, or in the case of a divorce situation, a student may belong to more than one family and each of the families may maintain a profile.

Test Message

Parent registration of electronic devices used for receiving alert messages must be entered into the school alert system correctly in order to receive alerts. In order to verify that information is entered correctly, a parent may enter electronic device address information into their user profile and select a test message option which signals the school alert system to send a test message to some or all of the devices entered into the system.

Figure 8:
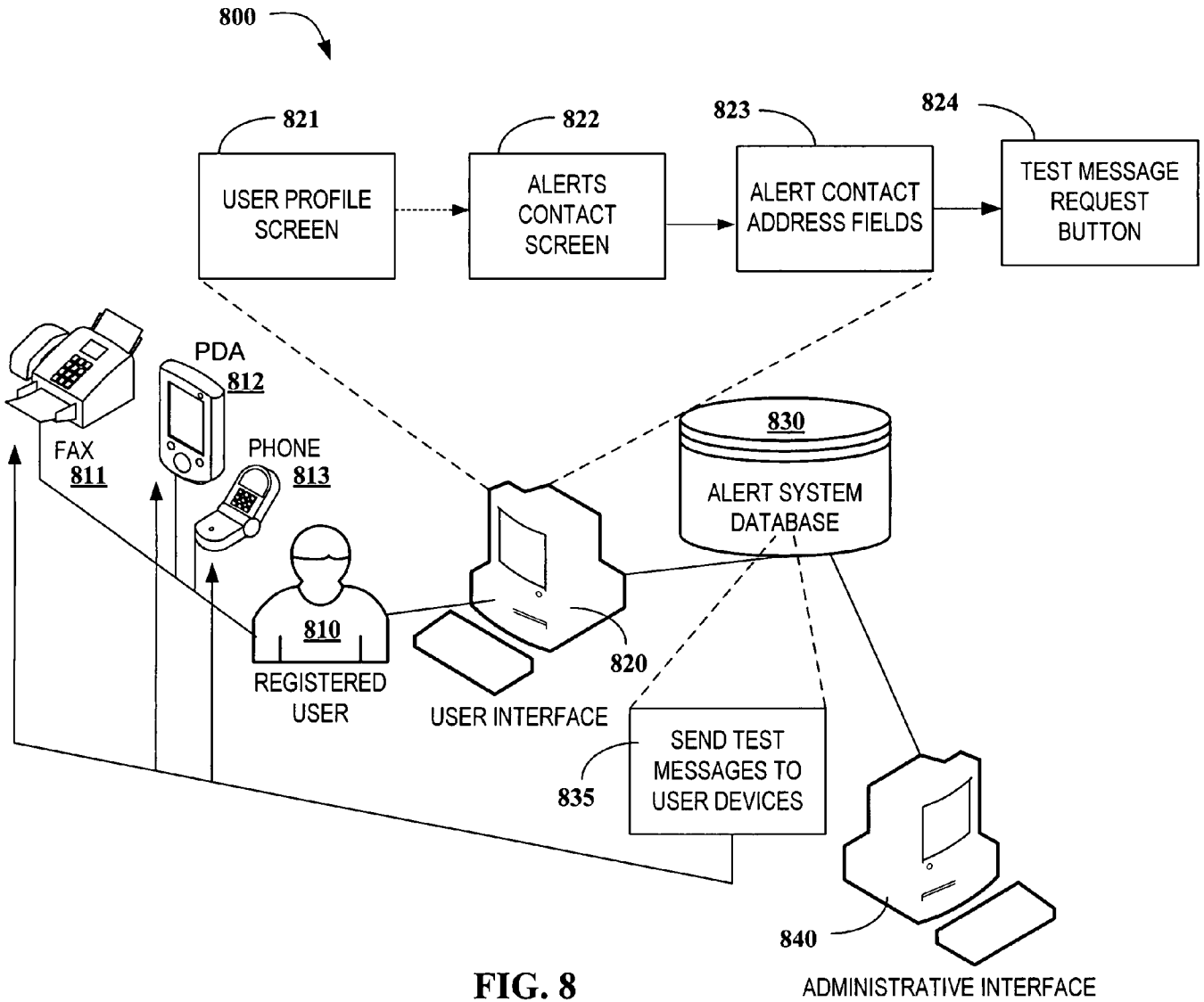
FIG. 8 is a block diagram illustrating a test message process according to an embodiment of the invention.

Referring to FIG. 8, block diagram depicts school alert system 800 having test message capabilities according to an embodiment of the invention. According to FIG. 8, school alert system 800 includes a user interface 820 and an administrative interface 840, which are both communicatively coupled to alert system database 830. Registered user 810 enters data at user interface 820 which provides screens, 821 and 822, for facilitating entry of user information. User profile screen 821 allows user 810 to enter personal information, for example. An alerts contact screen 822, which may be linked to the user profile screen 821, provides fields 823 for user 810 to enter contact addresses for receiving alerts. User 810 may enter several addresses for a variety of communication devices in the fields 823 provided in the alerts contact screen 822, and each device with its associated address may be sent a test message 835 according to an embodiment of the invention.

For example, user 810 may enter contact addresses into alert system database 830 for a fax machine 811, a PDA 812, and a phone 813. Each device address entered may be used by alert system database 830 to send alerts, and in accordance with the invention, each device address entered may be used by alert system database 830 to send test messages 835. Test messages received at user provide verification for the user 810 that the alert addresses were entered correctly.

Test messages may be sent to the devices in a variety of ways, including upon user 810 selecting a test message request button 824. Similarly, alert system database 830 may automatically deploy a pop-up screen at user interface 820 allowing user 810 to accept or reject the option of receiving a test message at any or all of the devices entered. In another example, alert system database 830 may automatically send a test message to some or all devices addresses entered by user 810.

In further embodiments of the invention, the alert system database 830 may receive confirmation signals, such as a message, from the devices that received test messages. The test message received at the user device may include a response option that requires the user 810 to dial a number to confirm the number is correct, or to dial a different number if the message was received in error. This allows for database verification that the information stored on the alert system database 830 is accurate. The successful reception of the confirmation may also be indicated to the user 810 via the user interface 820.

Additionally, alert system database 830 may periodically send test messages to and request a response from destination devices to ensure the device addresses entered in the alert system database 830 are operational. For example, a cellular phone number may have been entered into alert system database 830 that was operational, but is no longer used by user 810. The phone number may not be operational, or it may have been assigned to a non-user. Sending a test message to the number would result in receiving no response, or possibly a negative response. Alert system may conclude that the cellular phone number previously registered should not receive alerts, and the alert system database 830 may delete the cellular phone number and flush the system of outdated or inaccurate contact information.

Figure 9:
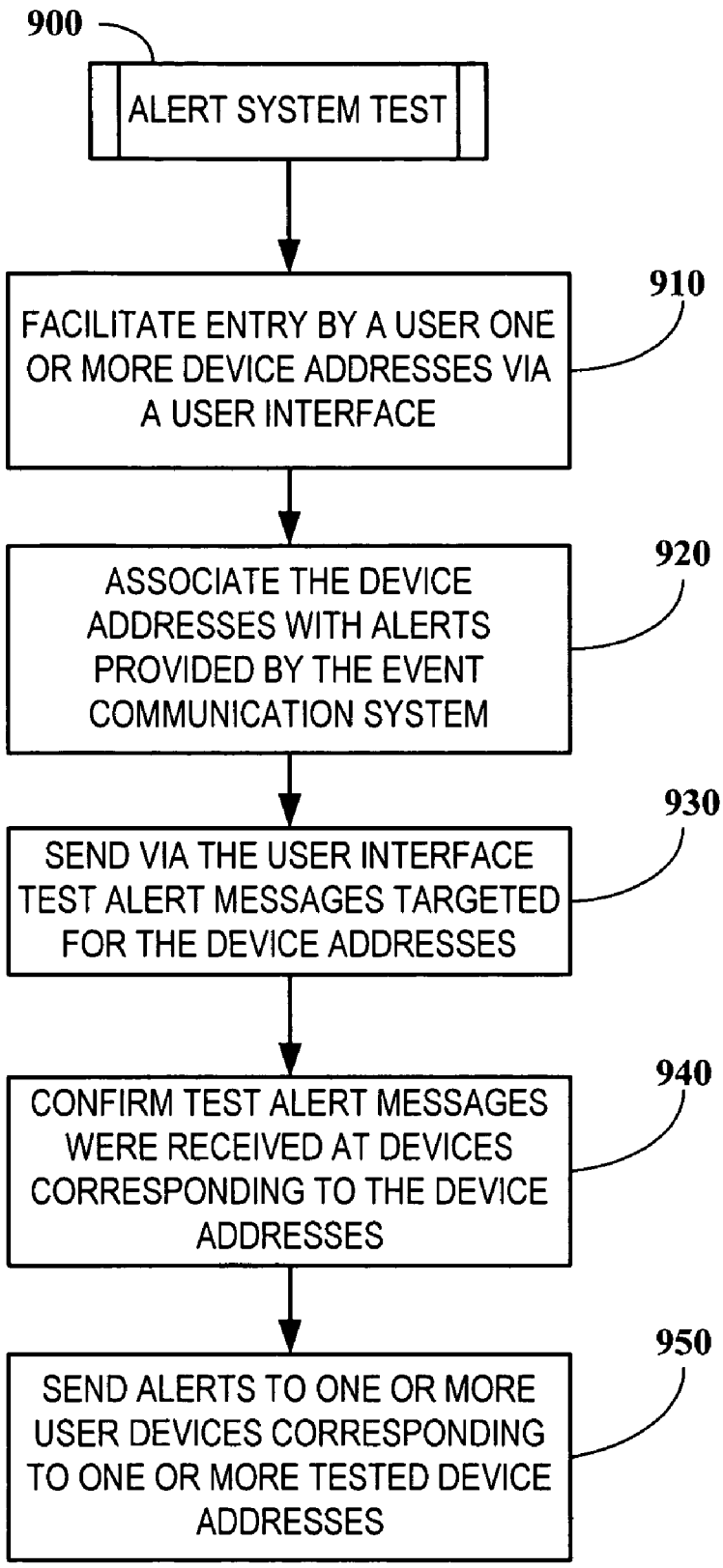
FIG. 9 is a flowchart illustrating a test message procedure according to an embodiment of the invention.

FIG. 9 is a flowchart of an exemplary method 900 for providing a SAS having test messaging capabilities according to the present invention. According to FIG. 9, the school alert system facilitates 910 user entry of one or more device addresses corresponding to devices used for receiving alerts. The entered device addresses associated 920 with alerts at the SAS, and a test message is sent 930 to some or all of the stored device addresses each having their corresponding user device. Receipt of the test alert messages is confirmed 940, and alert messages are thereafter sent 950 to the user devices having the corresponding tested device addresses.

Figure 10A:
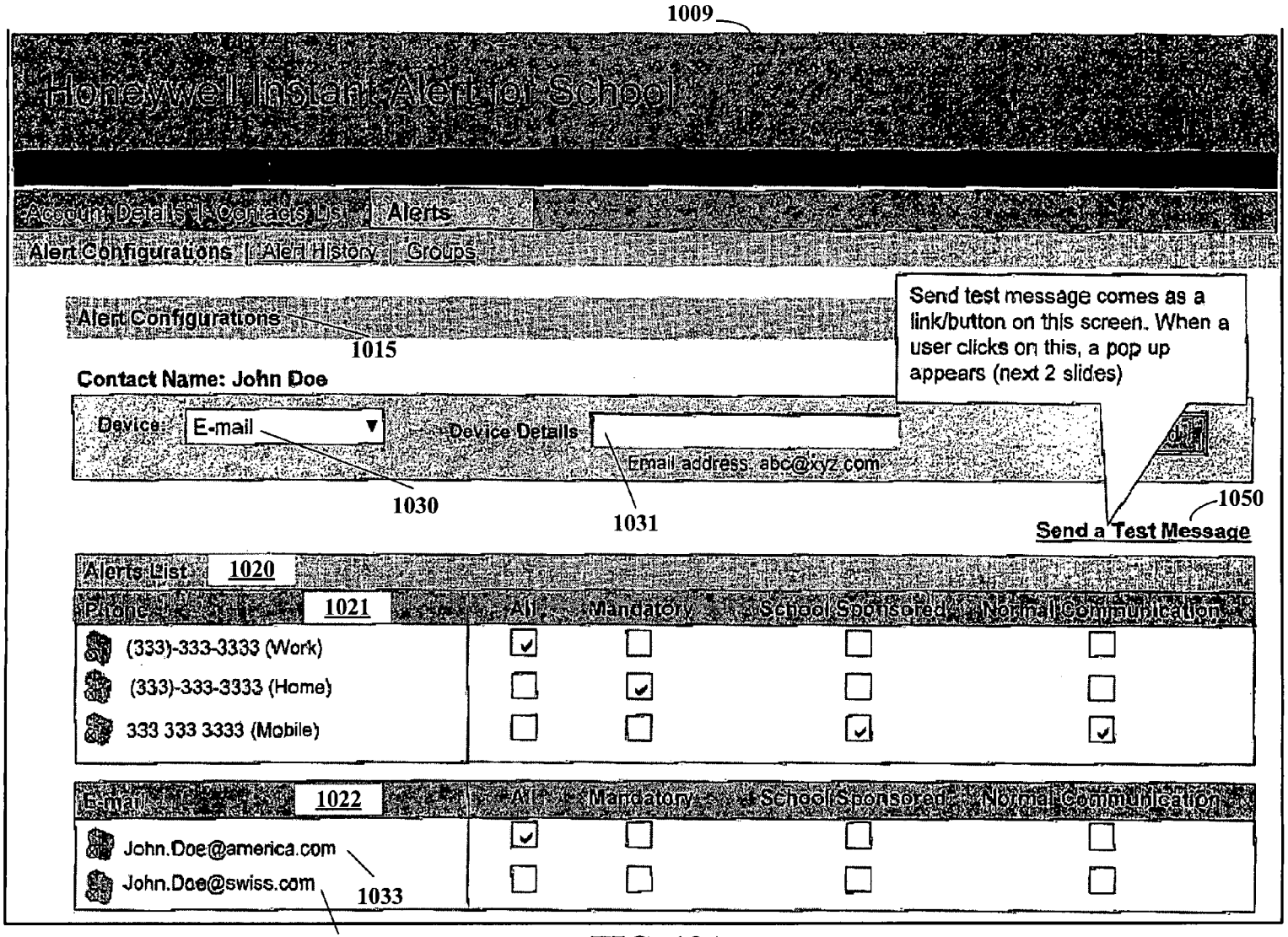
FIGS. 10A, 10B, and 10C are user interface diagrams illustrating a test message interface according to embodiments of the invention.
Figure 10B:
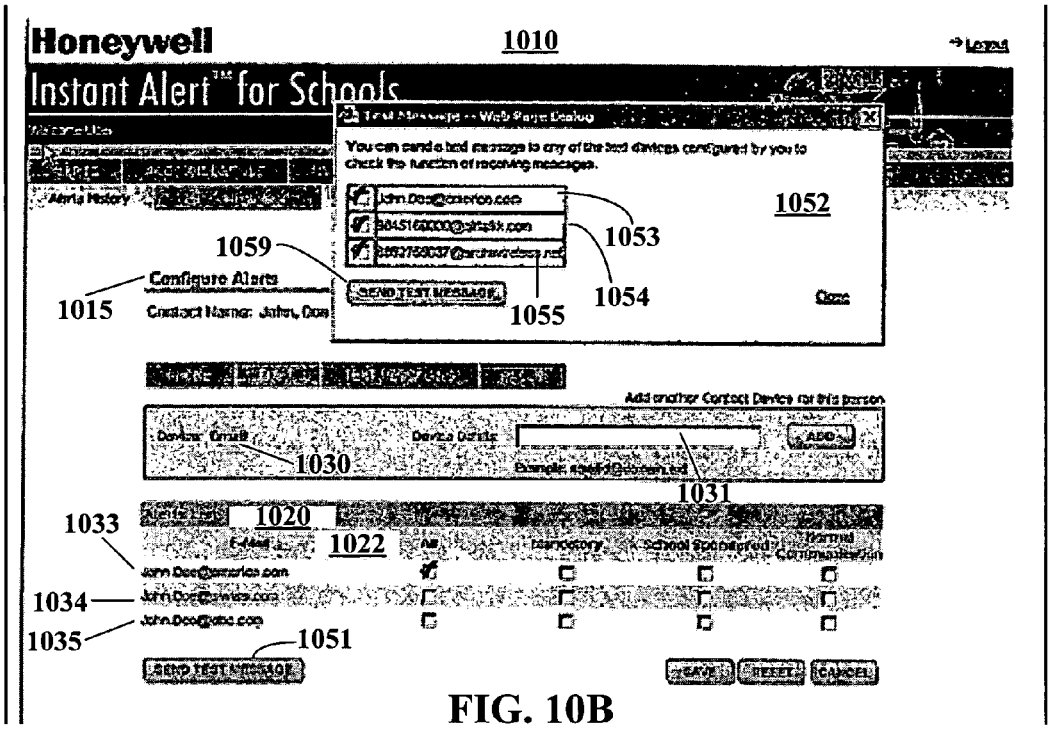
Figure 10C:
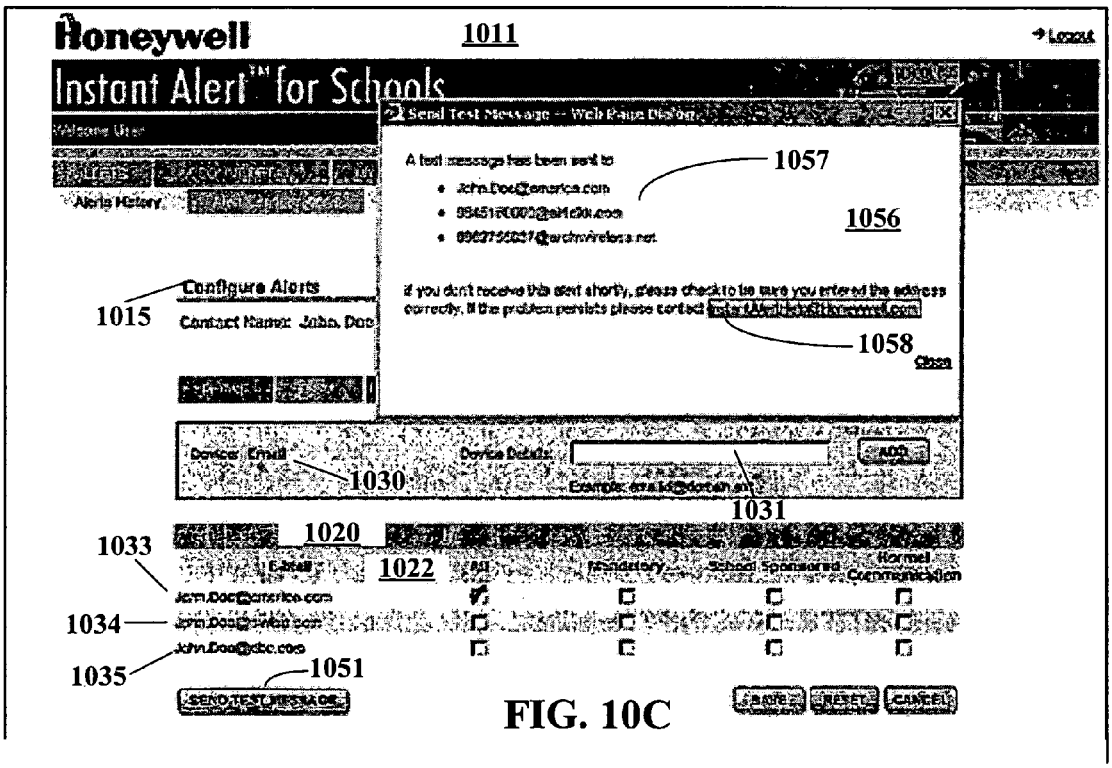

FIGS. 10A-10C illustrate exemplary screens 1009, 1011, and 1011 that may be presented at user interface 820 to facilitate user 810 entry of and system testing of alert data according to the present invention. Screen 1009 of FIG. 10A illustrates an alert configurations 1015 section of a user profile. The alert configurations 1015 section includes an alerts list 1020 with both a phone section 1021 and an e-mail section 1022. At the alerts configurations 1015 section shown, the email 1030 device option allows the user to enter their email addresses at the device details field 1031. Once e-mail addresses are entered and stored in the alerts database, the e-mail addresses, 1033 and 1034, are listed in the e-mail section 1022 of the alerts configurations 1015 section. Screen 1009 further includes a send a test message link 1050 that may be selected by a user.

Screen 1010 in FIG. 10B is a variant of screen 1009, and includes an exemplary pop-up window 1052 according to the present invention. The screen 1009 having the "send test message button" 1051 may be the result of the user selecting the send a test message link 1050 from FIG. 10A, for example. Once the "send test message" button 1051 is selected, pop-up window 1052 is sent to the user interface.

The pop-up window 1052 includes e-mail addresses 1053, 1054, and 1055 that correspond to the e-mail addresses 1033, 1034, and 1035 entered in the e-mail section 1022 of alerts list 1020. A user may choose to select some or all of the e-mail addresses 1053, 1054, and 1055, and then press the "send test message" button 1059 within pop-up window 1052.

Screen 1011 in FIG. 10C is a variant of screen 1010, and illustrates a test message confirmation pop-up screen 1056, according to the present invention. When user selects the "send test message" button 1059 from FIG. 10B, a confirmation pop-up screen 1056 is sent to a user interface and lists 1057 the e-mail addresses the test message was sent to. If the user has problems receiving the test message, then a link 1058 found in pop-up screen 1056 can be used to contact an administrator to report the problem. Additionally or alternatively, if the user encounters problems, the user may double-check the addresses the e-mail test messages were sent and verify that the addresses were entered correctly.

Although the examples in FIGS. 10A-10C illustrate screens for facilitating sending test messages to user e-mail addresses, test messages may be sent to any or all devices entered into a user's profile. Furthermore, the test messages sent to user devices may be standard messages, or may be customized according to device, user group, and/or an alert level assigned to the device, for example.

Membership

Individuals registered on the school alert system may be members of a variety of school alert groups. In particular, it may be convenient for both administrators and users to have certain alerts limited to certain groups. Use of groups allows administrators and school officials to easily notify large numbers of people of important events, while reducing message traffic by not sending messages to uninterested or unaffected individuals.

Figure 11:
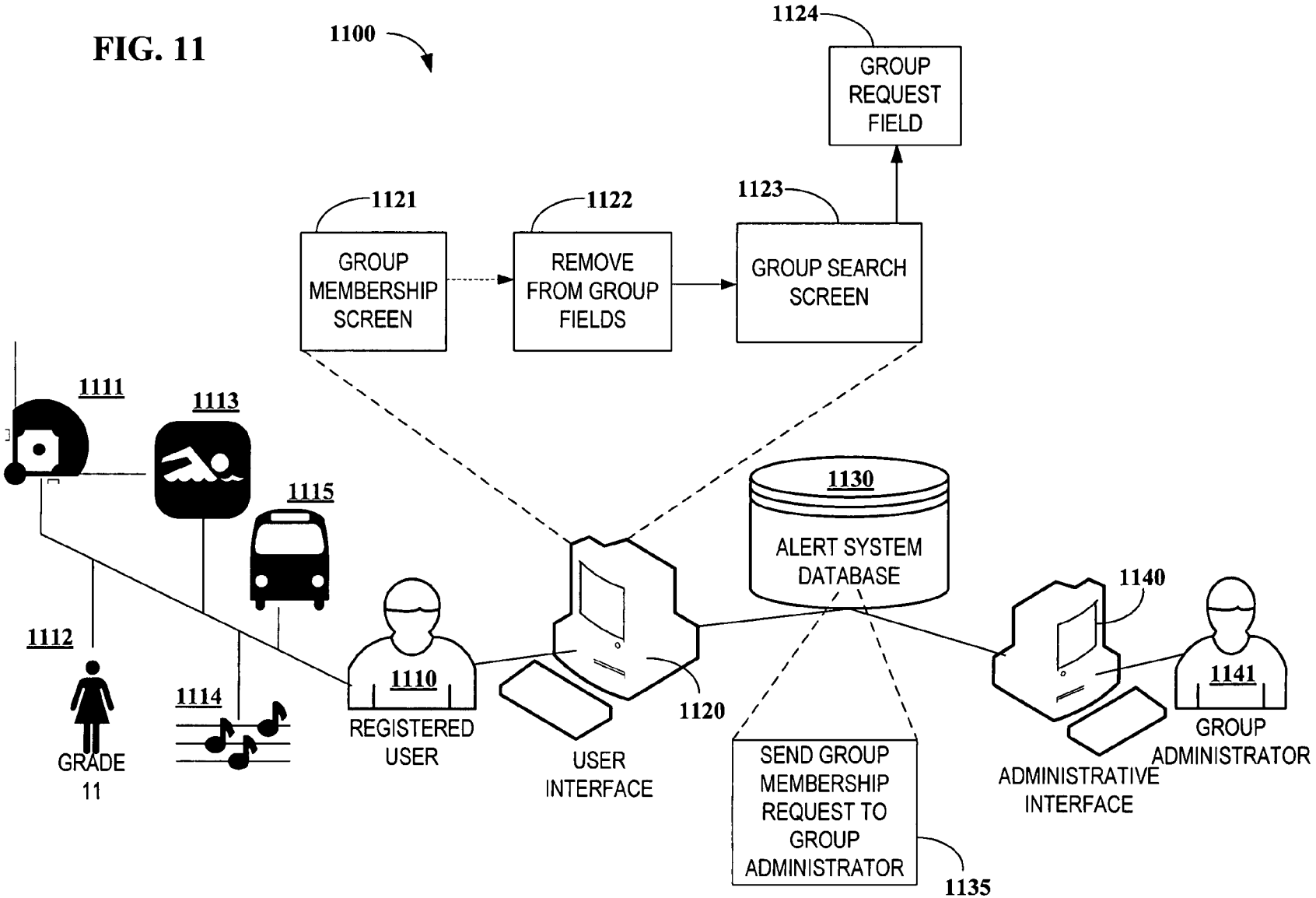
FIG. 11 is a block diagram illustrating user membership verification and modification processes according to an embodiment of the invention.

FIG. 11 illustrates a block diagram of an alert system 1100 that includes group creation and modification capabilities according to an embodiment of the invention. Alert systems database 1130 houses membership information for a variety of school groups, and sends alerts to group members. Group memberships may be pre-defined and entered into the alert systems database 1130. Alternatively, groups and users having group membership status may be defined and modified by group administrator 1141 using administrative interface 1140. Information entered at administrative interface 1140 is then stored at alert systems database 1130. However, groups having pre-defined group members or administrator-defined members may be incomplete. Administrators may forget to enter parent and staff information into communication groups, or group members may change after a database has been pre-loaded.

According to an embodiment of the invention, the group's registered user 1110 may have memberships that may be reviewed at group membership screen 1121 via user interface 1120. If user 1110 has an undesired group membership and does not want to receive group alerts from the school alert system database 1130, user 1110 may request removal from the group by entering the information using "remove from group fields" 1122. Additionally or alternatively, if user 1110 is interested in reviewing other groups available on alert system database 1130, user 1110 may review groups at the "group search screen" 1123. User 1110 may request to join additional groups using group request fields 1124 found on group search screen.

In one example, user 1110 is a member of four alert groups, each corresponding with the user's association with the baseball 1111, grade 11 girls 1112, swimming 1113, and choir 1114 organizations. If user 1110 does not want to receive alerts from the choir group, user may request removal from the choir group at the "remove from group fields" 1122.

In another example, user 1110 may review available groups at "group search screen" 1123 and may decide they want to join a bus route group. User 1110 may enter the bus route group membership request in the "group request field" 1124. The group membership request is sent 1135 by alert system database 1130 to a group administrator 1141 for administrative review. If group administrator 1141 determines that user 1110 is associated with the bus organization 1115 for which the group membership is requested, then group administrator 1141 enters a signal at administrative interface 1140 indicating to alert system database 1130 that user 1110 is to be added to the group membership list and is to receive group alerts at the alert devices of the user's choosing. If group administrator 1141 determines that user 1110 should not be given membership status to the desired group, then group administrator 1141 may signal alert system database 1130 to not change the group membership and to send a membership rejection message to user 1110 at user interface 1120, for example.

Figure 12:
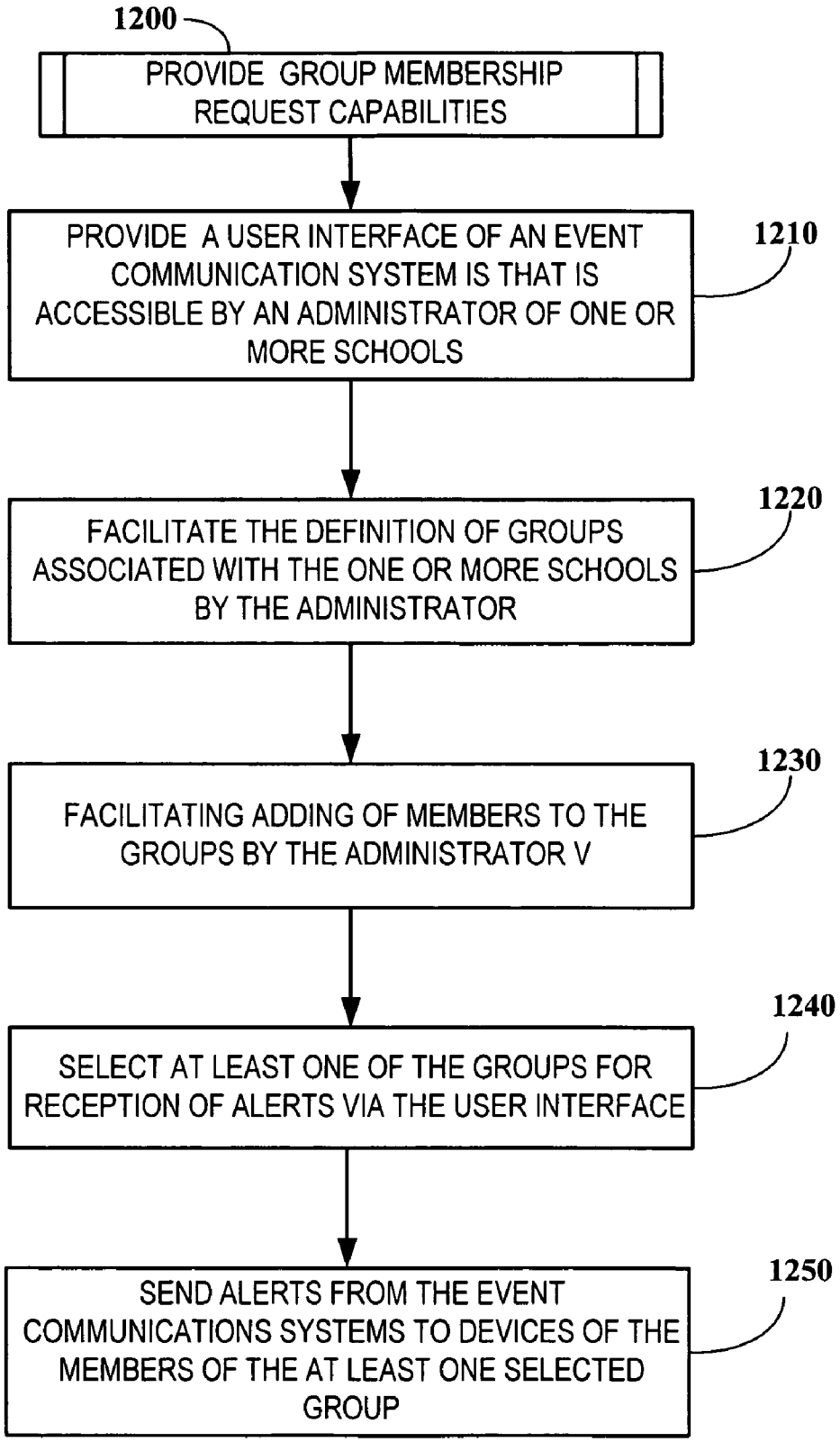
FIG. 12 is a flowchart illustrating a group membership procedure according to an embodiment of the invention.

FIG. 12 is a flowchart of a method 1200 for providing a school alert system having group membership capabilities in accordance with an embodiment of the invention. A user interface of an event communication system is provided 1210 that is accessible by an administrator of one or more schools. The definition of groups associated with the one or more schools by the administrator is facilitated 1220 via the user interface. The adding of members to the groups by the administrator is also facilitated 1230 via the user interface. At least one of the groups is selected 1240 for reception of alerts via the user interface, and alerts are sent 1250 from the event communications systems to devices of the members of the at least one selected group.

Figure 13A:
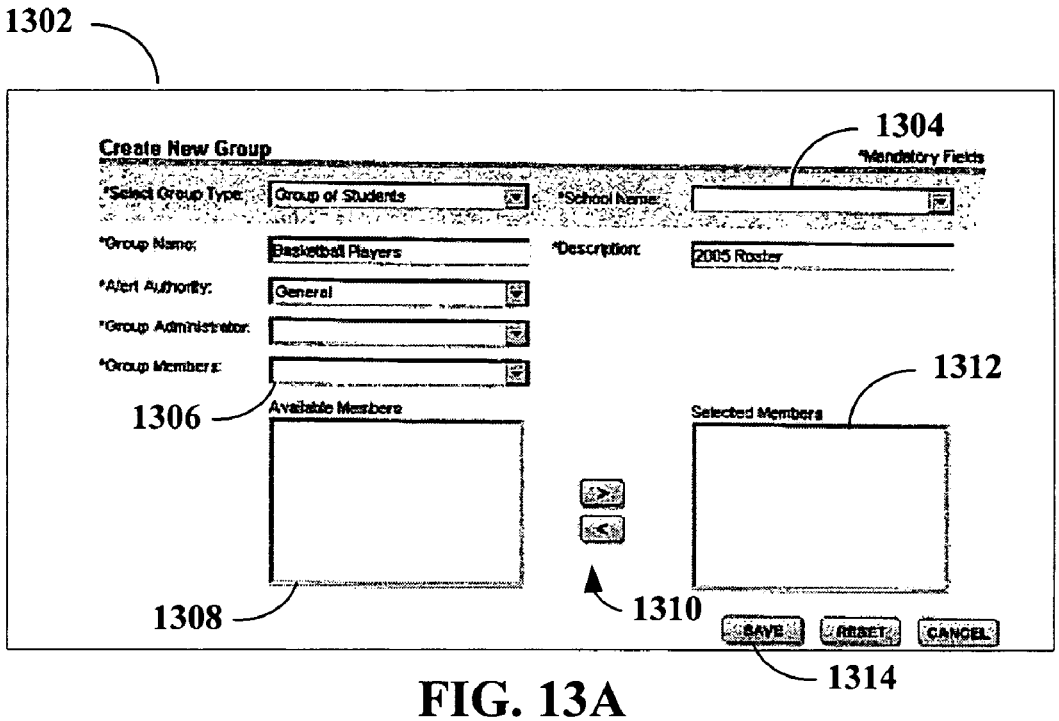
FIGS. 13A and 13B are user interface diagrams illustrating a group management interface according to embodiments of the invention.
Figure 13B:
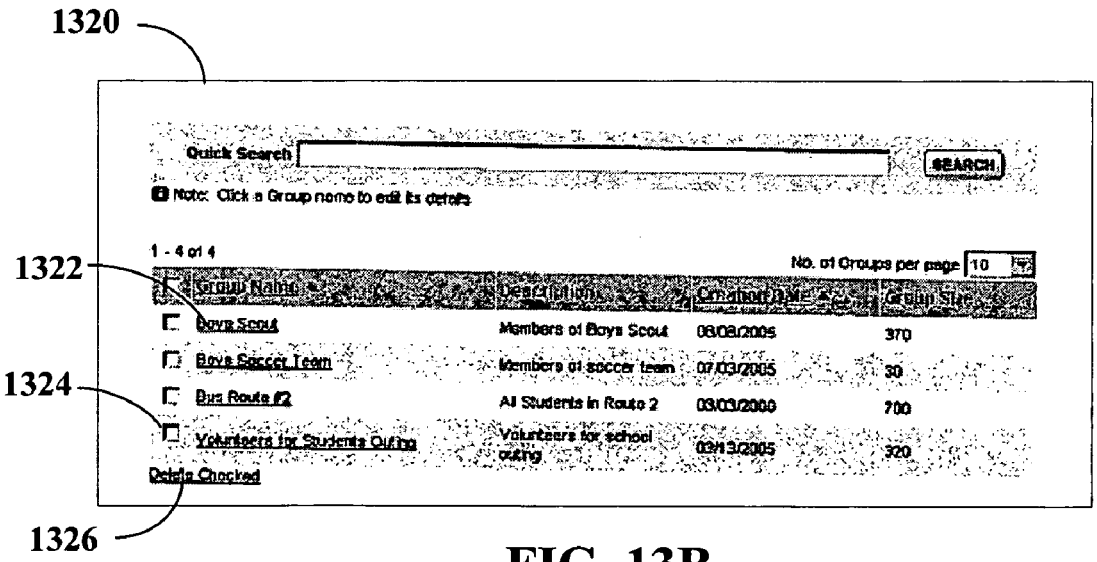

In reference now to FIGS. 13A-B, example screens 1302, 1320 illustrate user interfaces that allows a school administrator to create and manage groups according to embodiments of the invention. The group creation screen 1302 in FIG. 13A may be presented when a district administrator (or other person having group creation authority) logs in and navigates to the Groups screen. The screen 1302 appears when the administrator selects a "Create Group" button. The screen 1302 allow the administrator to select various mandatory and optional parameters of the group, including a group type, a group name/description, alert authority, administrator name, and an individualized list of members.

A school name selection list 1304 and group member list 1306 provide the administrator with controls needed to populate the group with individual members. A school is selected from the school list 1304, and in response, the group members list 1306 is populated with the groups that already exist in that school (e.g., staff, parents, 3rd grade, etc). Selection of a group from the group members list 1306 causes an available member list 1308 to be populated with individuals from the selected group. Individuals in the available member list 1308 can be moved to and from a selected member list 1312 via arrow buttons 1310. The selected members list 1312 contains a cumulative collection of individuals for the targeted group. After the members from a particular group and school are added to the list 1312, additional groups and schools can be selected via the school and group lists 1304, 1306, and the process repeated.

Once the selected members list 1312 is complete, the members of the selected members list 1312 are associated with the group by selecting a save button 1314. The association between groups and associated members are stored in a database or other persistent storage. Thereafter, the created group is visible in the group management screen 1320 (FIG. 13B) and messages can be directed to the group.

After groups are created using screen 1302 (or by other means), the group management screen 1320 allows existing groups to be viewed and modified. Generally, the groups can be edited by selecting a hyperlink (e.g., link 1322), and can be selected for deletion via checkboxes (e.g., checkbox 1324) and a delete link 1326. The creation of groups as shown in FIGS. 13A and 13B allows communication to district-wide groups. For example, groups may include a group of all principals in the district, bus route groups that cross schools, sports teams that draw kids from multiple schools, all kids in a particular grade throughout the district, etc.

User Profile Alerts Section

The user profile area of the school alert system is accessed by a parent to configure their personal settings. In accordance with the invention, the user profile area may additionally be used as an alerts repository for storing received alerts. This allows a user who does not have access to other communication devices to view alerts via their user profile at any computer having Internet capabilities. The school alert system database itself provides a parent with an alert resource.

Figure 14:
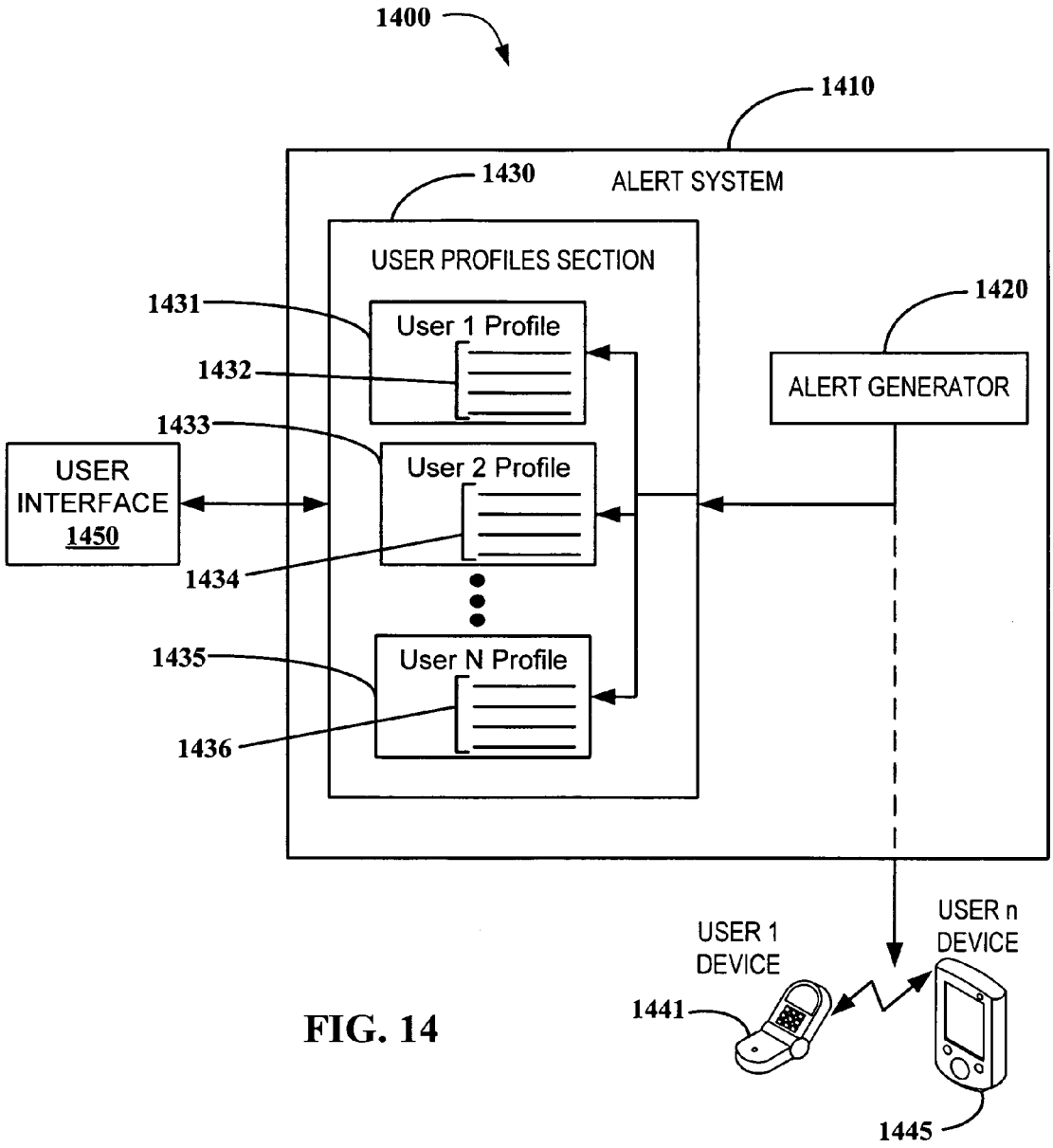
FIG. 14 is a block diagram illustrating user access to alerts via a user's online profile according to an embodiment of the invention.

FIG. 14 illustrates alert system 1400 that facilitates user access to alerts via a user's online profile according to an embodiment of the invention. Alert system 1400 includes alert system database 1410 that houses alert generator 1420 for sending alerts, and a user profiles section 1430. Alert generator 1420 sends alerts to user profiles 1431, 1433, and 1435 and the alerts are stored in the user profiles in alert storage areas 1432, 1434, and 1436, respectively.

In addition, alert generator 1420 sends alerts to user devices that are associated with user profiles. For example, user-1 device 1441 is a phone that is associated with the user-1 profile. If an alert is sent to the user-1 profile, the alert may also be sent to the user-1 device 1441 if settings on the profile indicate that the phone is designated as a device that receives the type of alert sent. Similarly, when user-N profile 1435 receives an alert, user-N device 1445, a PDA, may receive the same alert. Any alert sent to a user will be sent to the user's profile and be stored until the user deletes the alert. The user's personal profile determines whether or not other user devices will receive the messages. The user profile may be configured so that some devices may receive alerts of a particular type, and not alerts of another type.

Although the school alert system allows users to enter alert device information for receiving alerts, school alert system users are not required to enter alert device information in order to use the system. Instead, a user may choose to view alerts by accessing their user profile via user interface 1450. For example, user-2 profile 1433 does not have additional communication devices associated with it. Because all alerts sent to the user, and the alerts received are stored in the alert storage area 1434, user may view their alert history at user interface 1450.

Figure 15:
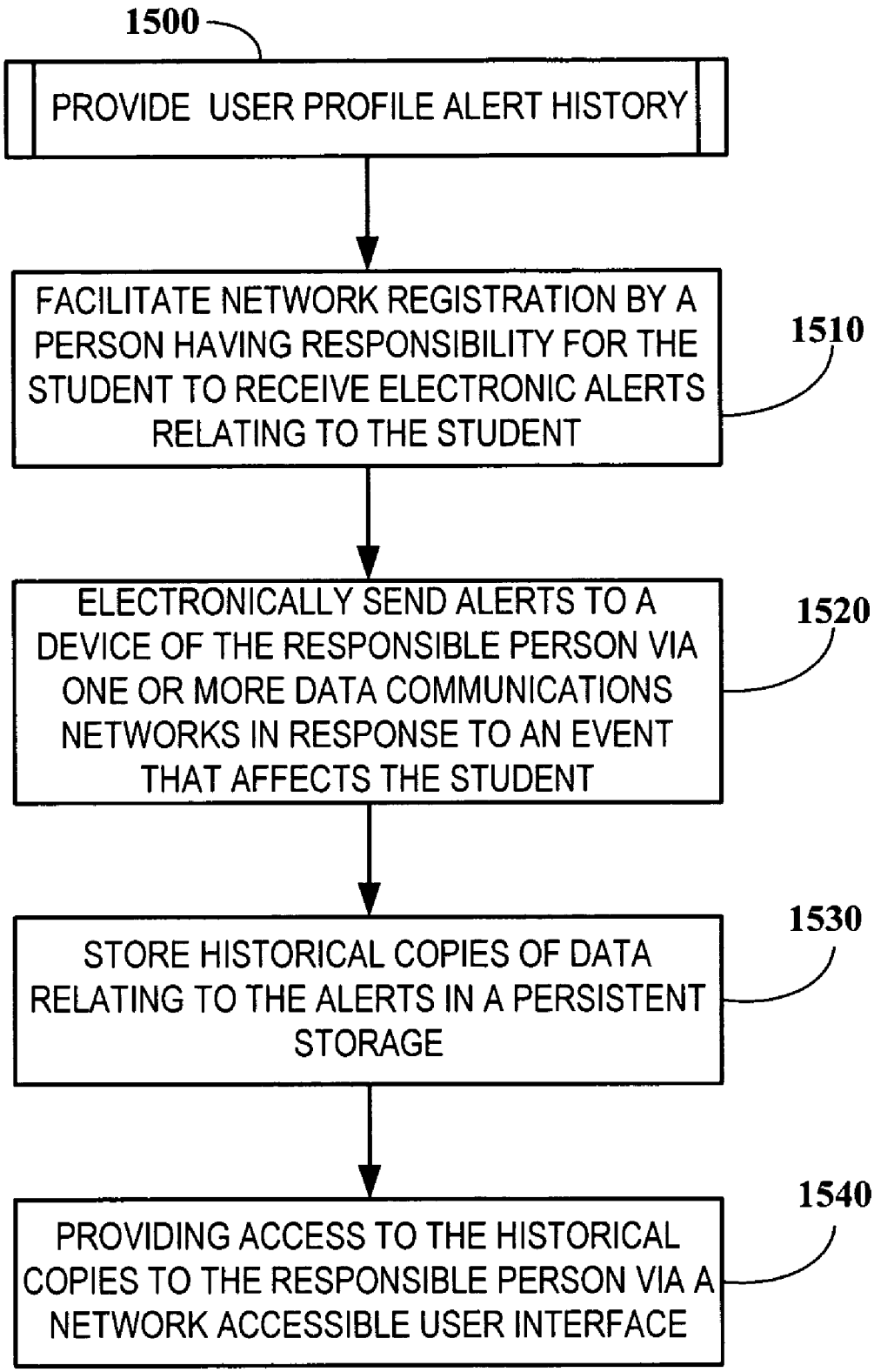
FIG. 15 is a flowchart illustrating a procedure for accessing alerts via an online profile history according to an embodiment of the invention.

FIG. 15 is a flowchart of a method 1500 for providing a school alert system having a user profile alert history according to an embodiment of the invention. Network registration by a person having responsibility for the student is facilitated 1510 so that the responsible person will receive electronic alerts relating to the student. Alerts are electronically sent 1520 to a device of the responsible person via one or more data communications networks in response to an event affecting the student. Historical copies of data relating to the alerts are stored 1530 in a persistent storage. Access to the historical copies is provided 1540 to the responsible person via a network accessible user interface.

Figure 16A:
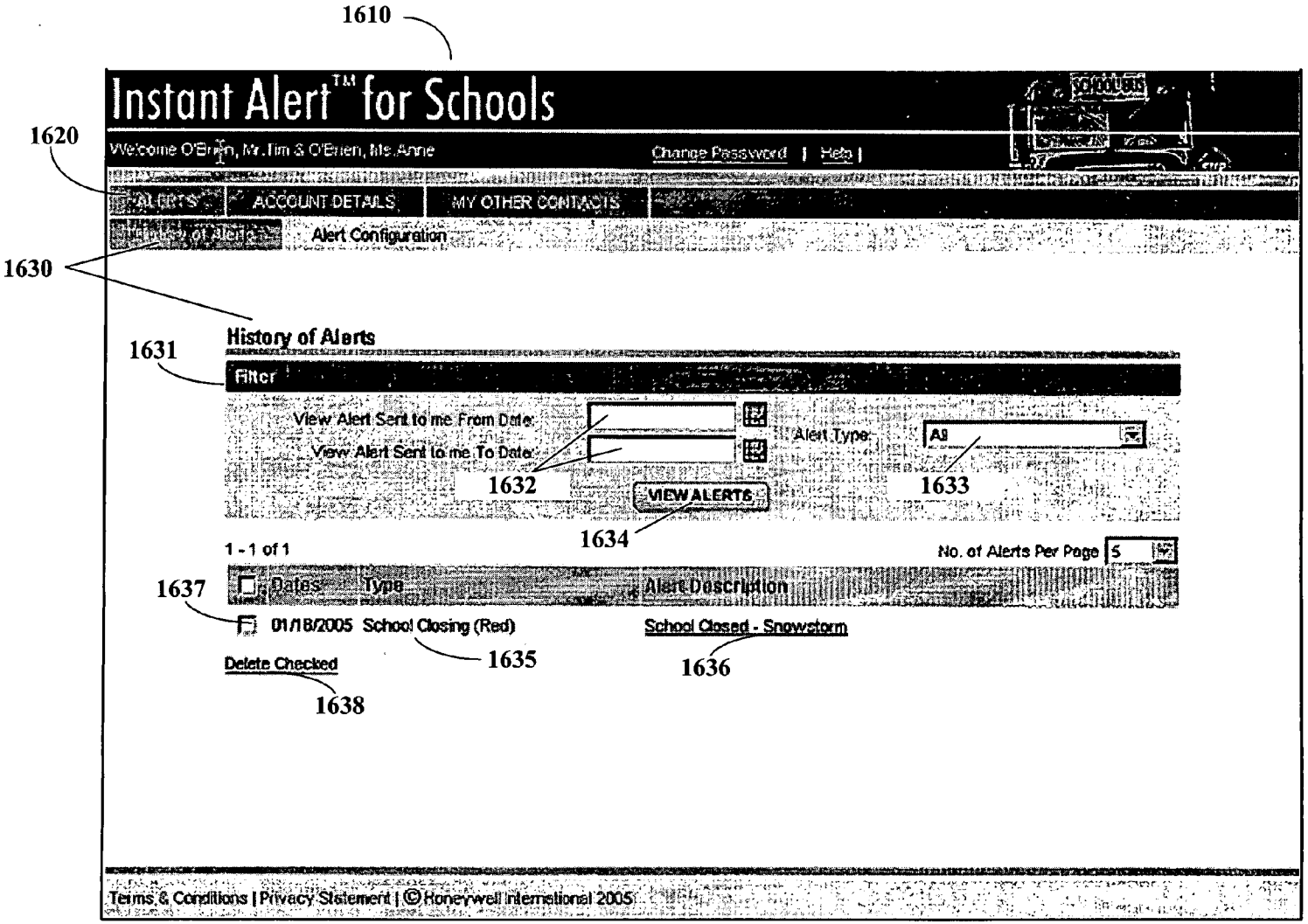
FIGS. 16A and 16B are user interface diagrams illustrating an alert history interface according to an embodiment of the invention.
Figure 16B:
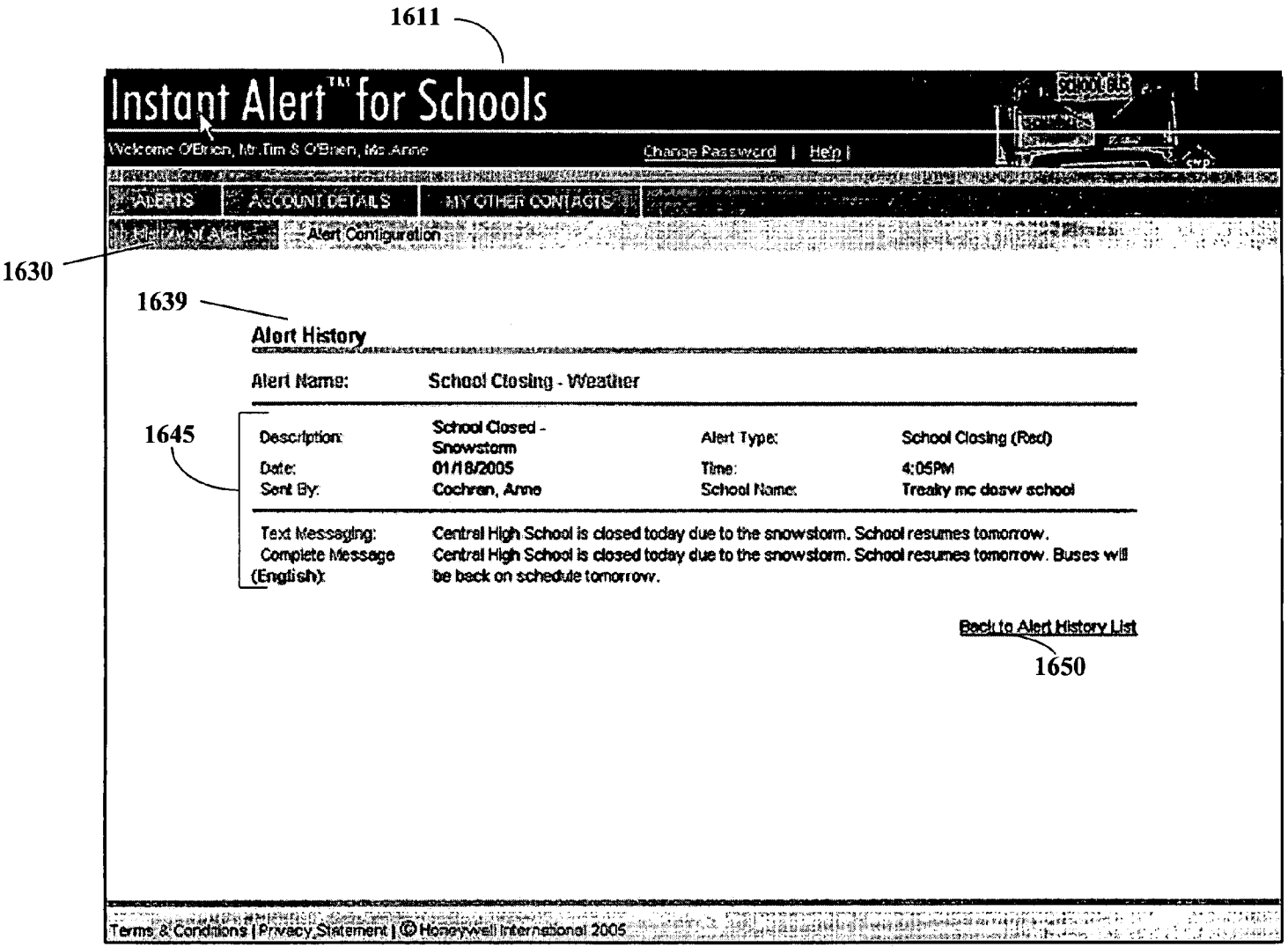

FIGS. 16A-16B illustrate exemplary screens 1610, 1611 enabling alert history viewing according to an embodiment of the invention. FIG. 16A illustrates the history of alerts 1630 section of alerts screen 1620. The history of alerts screen 1630 includes a filter 1631 allowing a user to enter a date range in to the date range fields 1632. The date range fields 1632 may be used to search for alerts within a certain date range, for example. In addition, alerts may be viewed by alert type by selecting an alert type in field 1633. Alert types may include all, mandatory, official, school sponsored, and general, for example. If "all" is selected as the alert type in field 1633, all alerts sent to a user's account are listed on screen 1610. Alternatively, if the "school sponsored" alert is set in field 1633, then only school sponsored events will be listed on screen 1610 once the "view alerts" button 1634 is selected. In FIG. 16A, the alert history listing includes a school closing (red) alert 1635. The alert 1635 may be viewed in further detail by clicking link 1636, or the alert 1635 may be deleted by checking box 1637 and selecting the "delete checked" link 1638. Alerts remain stored in the parent's personal profile until the alerts are selected for deletion. This prevents a parent from missing an alert, no matter how old the alert or how many alerts have been received, or if the original alert was deleted in an email or voicemail system.

If user selects link 1636 to show alert detail, user may be brought to screen 1611 depicted in FIG. 16B. The history of alerts screen 1630 includes an alert history section 1639 for viewing alerts in detail 1645 that may include alert description, date, sender, type, time, and school name. The alert history detail 1645 may further include the text of alert sent to text messaging devices, and the complete text of the alert. The history of alerts screen may be navigated to by selecting the "back to alert history list" link 1650.

Embodiments of the invention transform educational professionals' efforts and dedication into a useful product for parents and students. The school alert system shifts the burden of communicating important information to the right people in a timely manner from teachers and staff to the school alert system. Furthermore, the school alert system may be integrated into a broader portfolio of safety and security solutions to provide a protective framework for schools.

The foregoing description of various embodiments of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A method for testing an event communication system comprising:

facilitating entry by a user of one or more device addresses via a network accessible user interface of the event communication system;

associating the one or more device addresses with alerts provided by the event communication system;

sending via the user interface test alert messages targeted for the one or more device addresses;

confirming the test alert messages were received at one or more devices corresponding to the one or more device addresses; and sending the alerts to the one or more devices corresponding to the one or more tested device addresses in response to predetermined events occurring at a school.

2. The method of claim 1, wherein associating the one or more device addresses with alerts comprises associating each of the one or more device addresses with one or more alert classifications.

3. The method of claim 2, wherein associating each of the one or more device addresses with one or more alert classifications comprises associating each of the one or more device addresses with one or more alert levels.

4. The method of claim 2, wherein associating each of the one or more device addresses with the one or more alert classifications comprises associating each of the one or more device addresses with one or more subject matter classifications.

5. The method of claim 2, wherein associating each of the one or more device addresses with one or more alert classifications comprises selecting spaces in a grid presented via the network accessible user interface, wherein each selection of a space in a grid creates an association between a selected alert classification of the one or more alert classifications and a selected device address of the one or more device addresses.

6. The method of claim 1, further comprising sending a confirmation message from the one or more devices in response to receiving the test messages at the one or more devices.

7. The method of claim 6, further comprising indicating successful reception of the confirmation message via the user interface.

8. A system comprising:

one or more data communications networks;

a user manager module configured to, for each student at one or more schools, store a device address that can be used to access a communications device of a person responsible for each student via the data communications networks;

an alerts module capable of communicating with the user manager module and configured to, receive an event notification via an authority associated with the one or more schools;

send an alert to selected device addresses in response to the event notification; and a user interface module capable of processing user inputs and outputs via one of the data communications networks, the user interface module capable of communicating with the user manager module and alerts module and configured to, for a selected person responsible for at least one of the students, enable sending of a test message by the selected responsible person via the alerts module to the device address that can be used to access the communication device of the selected responsible person.

9. The system of claim 8, wherein the user manager is further configured to, associate the device address of each responsible person with one or more alert classifications.

10. The system of claim 9, wherein the alerts module is further configured to, receive an event notification corresponding to a selected alert classification via an authority associated with the one or more schools;

in response to the event notification, select device addresses associated with the selected alert classification and send an alert to the selected device addresses.

11. A method comprising:

storing on a database personal identity information associated with a student;

facilitating entry of registration information via a network accessible user interface by a person responsible for the student who has personal knowledge of the personal identity information;

comparing a specified portion of the personal identity information and the registration information;

registering the responsible person for reception of alerts at one or more communications devices accessible by the responsible person based on a successful comparison of the specified portion of the personal identity information and the registration information; and providing the alerts via a data communications network to the one or more communications devices based on the registration.

12. The method of claim 11, further comprising facilitating entry of personal identity data associated with the responsible person via the network accessible user interface in response to the registration for purposes of storing the personal identity data associated with the responsible person on the database.

13. The method of claim 11, wherein storing on the database the personal identity information associated with the student at the school comprises importing the personal identity information from a legacy data source.

14. The method of claim 11, wherein storing on the database the personal identity information associated with the student at the school comprises setting a default alert configuration used for providing alerts via the data communications network to the one or more communications devices accessible by the responsible person.

15. The method of claim 14, further comprising providing the responsible person secure access to the database via the network accessible user interface for purposes of modifying the default alert configuration.

16. The method of claim 11, wherein storing on the database the personal identity information associated with the student comprises storing a question and answer, wherein the person responsible for the student has personal knowledge of the answer.

17. The method of claim 11, wherein storing on the database the personal identity information associated with the student comprises storing at least one of a school name, a state name, a home phone number, and a birth date of the student.

18. The method of claim 11, wherein registering the responsible person with the system comprises associating each address of the one or more communications devices with one or more alert classifications.

19. The method of claim 18, wherein associating each address with the one or more alert classifications comprises associating each address with one or more alert levels.

20. The method of claim 18, wherein associating each address with the one or more alert classifications comprises associating each address with one or more subject matter classifications.

21. The method of claim 18, wherein associating each address with the one or more alert classifications comprises selecting spaces in a grid presented via the network accessible user interface, wherein each selection of a space in a grid creates an association between a selected alert classification of the one or more alert classifications and a selected device address of the one or more communications devices.

22. A system comprising:

one or more data communications networks;

a user manager module configured to store personal identity data associated with each student at one or more schools;

a user interface capable of processing user inputs and outputs via one of the data communications networks, the user interface capable of communicating with the user manager module and configured to, receive via the network registration data from responsible persons each of whom has personal knowledge associated with at least one of the students;

determine, via the manager module, that registration data matches a selected portion of the personal identity data associated with the at least one student; and provide access to alerts configuration data associated with the at least one student in response to determining the registration data matches the selected portion of the personal identity data associated with the at least one student; and an alerts module configured to, receive an event notification via an authority of the one or more schools;

send an alert via the one or more data communications networks to devices of the responsible persons in response to the event notification based on the alerts configuration data.

23. A method comprising:

providing a user interface of an event communication system that is accessible by an administrator of one or more schools;

facilitating the definition of groups associated with the one or more schools by the administrator via the user interface;

facilitating the adding of members to the groups by the administrator via the user interface;

selecting at least one of the groups for reception of alerts via the user interface; and sending alerts from the event communications systems to devices of the members of the at least one selected group.

24. The method of claim 23, wherein facilitating the definition of groups comprises defining groups associated with school activities.

25. The method of claim 23, wherein facilitating the adding of members to the groups comprises selecting a school from a list of the one or more schools, wherein potential members associated with the selected school are selectable for addition to the groups based on the selection of the selected school.

26. The method of claim 23, wherein facilitating the adding of members to the groups comprises selecting a school from a list of the one or more schools, wherein a plurality of existing groups associated with the selected school are selectable for addition to the groups based on the selection of the selected school.

27. The method of claim 26, wherein facilitating the adding of members to the groups comprises selecting an existing group from the plurality of existing groups, wherein members associated with the selected existing group are selectable for addition to the group based on the selection of the selected existing group.

28. The method of claim 23, wherein facilitating the definition of groups comprises forming an alert hierarchy having a plurality of groups within each of the one or more schools.

29. The method of claim 28, wherein sending the alert comprises sending the alert to a selected school, and wherein the alert is sent to the plurality of groups within the selected school.

30. The method of claim 28, wherein forming the alert hierarchy further comprises forming one or more districts, wherein each of the one or more schools is within selected ones of the one or more districts.

31. The method of claim 30, wherein sending the alerts comprises:

sending the alert targeted for a selected district of the one or more districts;

sending the alert to each group within each school within the selected district.

32. A system comprising:

one or more data communications networks;

a user interface capable of processing user inputs and outputs via one of the data communications networks, the user interface configured to, allow a school administrator to define groups associated with one or more schools; and allow the administrator to add members to the groups; and an alerts module coupled to the user interface and the one or more data communications networks, the alerts module configured to, detect selection of at least one of the groups via the user interface for purposes of sending messages to the at least one group; and sending alerts to devices of the members of the selected group via the one or more data communications networks.

33. A method comprising:

facilitating network registration by a person having responsibility for a student to receive electronic alerts relating to the student;

electronically sending alerts to a device of the responsible person via one or more data communications networks in response to an event affecting the student;

storing historical copies of data relating to the alerts in a persistent storage; and providing access to the historical copies to the responsible person via a network accessible user interface.

34. The method of claim 33, wherein providing access to the historical copies of the data comprises providing the capability to search through the historical copies of the data via the network accessible user interface.

35. The method of claim 33, further comprising detecting that the responsible person viewed the historical copies of the data relating to the alerts.

36. The method of claim 35, further comprising storing in the database records of whether the responsible person viewed the historical copies of the data relating to the alerts.

37. The method of claim 33, wherein storing the historical copies of data relating to the alerts in the persistent storage comprises storing text messages contained in the alerts.

38. The method of claim 33, wherein storing the historical copies of data relating to the alerts in the persistent storage comprises storing at least one of alert dates, alert times, alert categories, and senders of the alerts.

39. The method of claim 33, further comprising:

checking an age of the historical copies; and preventing automatic deletion of historical copies that satisfy a predetermined age.

40. A system comprising:

one or more data communications networks;

a persistent storage capable of storing data; and an alerts module capable of processing user inputs and outputs via a selected one of the data communications networks, the alerts module capable of communicating with the database and configured to, allow to a person having responsibility for a student to register to receive electronic alerts relating to the student;

electronically send alerts to a device of the responsible person via the data communications networks in response to an event affecting the student;

store historical copies of data relating to the alerts in the persistent storage;

provide access to the historical copies to the responsible person via the selected one of the data communications networks.

* * * * *